US010287884B2

(12) United States Patent
Kennedy et al.

(10) Patent No.: US 10,287,884 B2
(45) Date of Patent: May 14, 2019

(54) MINE STOPPING PANEL AND METHOD OF SEALING A MINE STOPPING

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 15/703,562

(22) Filed: Sep. 13, 2017

(65) Prior Publication Data

US 2018/0080323 A1 Mar. 22, 2018

Related U.S. Application Data

(60) Provisional application No. 62/395,763, filed on Sep. 16, 2016.

(51) Int. Cl.
*E21F 1/14* (2006.01)
*E21F 17/103* (2006.01)

(52) U.S. Cl.
CPC ..... *E21F 17/103* (2013.01); *E21F 1/14* (2013.01)

(58) Field of Classification Search
CPC ... E21F 1/14; E21F 17/103; E21F 1/10; E21F 15/00
See application file for complete search history.

(56) References Cited

U.S. PATENT DOCUMENTS

| | | | | |
|---|---|---|---|---|
| 4,483,642 | A * | 11/1984 | Kennedy | E21F 17/103 405/132 |
| 4,695,035 | A * | 9/1987 | Kennedy | E21F 17/103 254/133 R |
| 6,220,785 | B1 | 4/2001 | Kennedy et al. | |
| 6,419,324 | B1 | 7/2002 | Kennedy et al. | |
| 7,267,505 | B2 | 9/2007 | Kennedy et al. | |
| 2005/0101243 | A1* | 5/2005 | Kennedy | E21F 17/103 454/169 |

* cited by examiner

*Primary Examiner* — Carib A Oquendo
(74) *Attorney, Agent, or Firm* — Stinson Leonard Street LLP

(57) ABSTRACT

A mine stopping panel for installation between opposing first and second mine surfaces of a mine passage includes a panel member. The panel member has a channel shape and a web, side flanges at opposite sides of the web, an upper end, and a lower end. An end cap is attached to the panel member adjacent one of the upper and lower ends of the panel member in a position between the side flanges of the panel member adjacent an inside surface of the web of the panel member. The end cap defines a cavity for receiving an injectable foam material and an injection inlet for injecting said foam material into the first cavity. In a method of the invention and injectable foam material is injected into the cavity through the injection inlet during a process of sealing the mine passage.

28 Claims, 21 Drawing Sheets

MINE STOPPING PANEL AND METHOD OF SEALING A MINE STOPPING

CROSS REFERENCE TO RELATED APPLICATION

The present invention claims priority to U.S. Provisional Application No. 62/395,763, filed Sep. 16, 2016, the contents of which are hereby incorporated by reference.

FIELD OF THE INVENTION

The present invention generally relates to mine stoppings and more particularly to systems and methods of sealing off a mine passage.

BACKGROUND OF THE INVENTION

So-called "stoppings" are widely used in mines to stop off the flow of air in passages in the mines, a "stopping" traditionally being a masonry (e.g., concrete block) or metal wall installed at the entrance of a passage to block flow of air therethrough. This invention relates especially, albeit not exclusively, to the type of metal mine stopping shown for example in U.S. Pat. No. 4,483,642 (Re. 32,675) comprising a plurality of elongate extensible panels extending vertically in side-by-side relation from the floor to the roof of a mine passage across the width of the passage. After the panels are installed, there are gaps between the panels and between the panels and adjacent surfaces of the mine (i.e., the floor, the roof and the ribs defining opposite sides of the passage). These gaps are typically sealed in a number of ways, as by spraying a foam, such as a polyurethane foam, on the stopping and around the stopping. However, when there is shifting and heaving of the mine in the vicinity of the passage (sometimes referred to as a "mine convergence"), sprayed-on foams tend to buckle away from the surfaces, exposing cracks. Cementitious sealants are also used, but mine convergence often causes the sealant to pop off the surfaces. More flexible sealants are sometimes used as well, but these are easily torn by relative movement of the panels, and they add no strength to the stopping.

U.S. Pat. No. 6,419,324 discloses a method of sealing a mine stopping by injecting a foaming material under pressure into the gaps between the vertical mine stopping panels to form a seal between adjacent panels. The '324 patent also describes spraying the foam in a line along the periphery of the stopping to fill or at least cover gaps between the stopping and the mine surfaces.

The present inventors have made various improvements in this field, which will be described in detail below.

SUMMARY

One aspect of the invention is a mine stopping panel adapted to be installed between opposing first and second mine surfaces of a mine passage. The panel includes a panel member of channel shape. The mine stopping panel member has a web, side flanges at opposite sides of the web, an upper end, and a lower end. An end cap is attached to the panel member adjacent one of the upper and lower ends of the panel member in a position between the side flanges of the panel member adjacent an inside surface of the web of the panel member. The end cap defines a cavity for receiving an injectable foam material and an injection inlet for injecting said foam material into the first cavity.

Another aspect of the invention is a method of sealing a mine passage. The method includes arranging a plurality of mine stopping panels in side-by-side relation to one another so the mine stopping panels extend between a floor and a ceiling of the mine to form a mine stopping. At least one of the mine stopping panels includes a panel member of channel shape. The panel member has a web, side flanges at opposite sides of the web, an upper end, and a lower end. An end cap is attached to the panel member adjacent one of the upper and lower ends of the panel member in a position between the side flanges of the panel member adjacent an inside surface of the web of the panel member. The end cap defines a cavity for receiving an injectable foam material and an injection inlet for injecting said foam material into the cavity. The method includes injecting a foam material into the cavity through the injection inlet.

Other aspects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
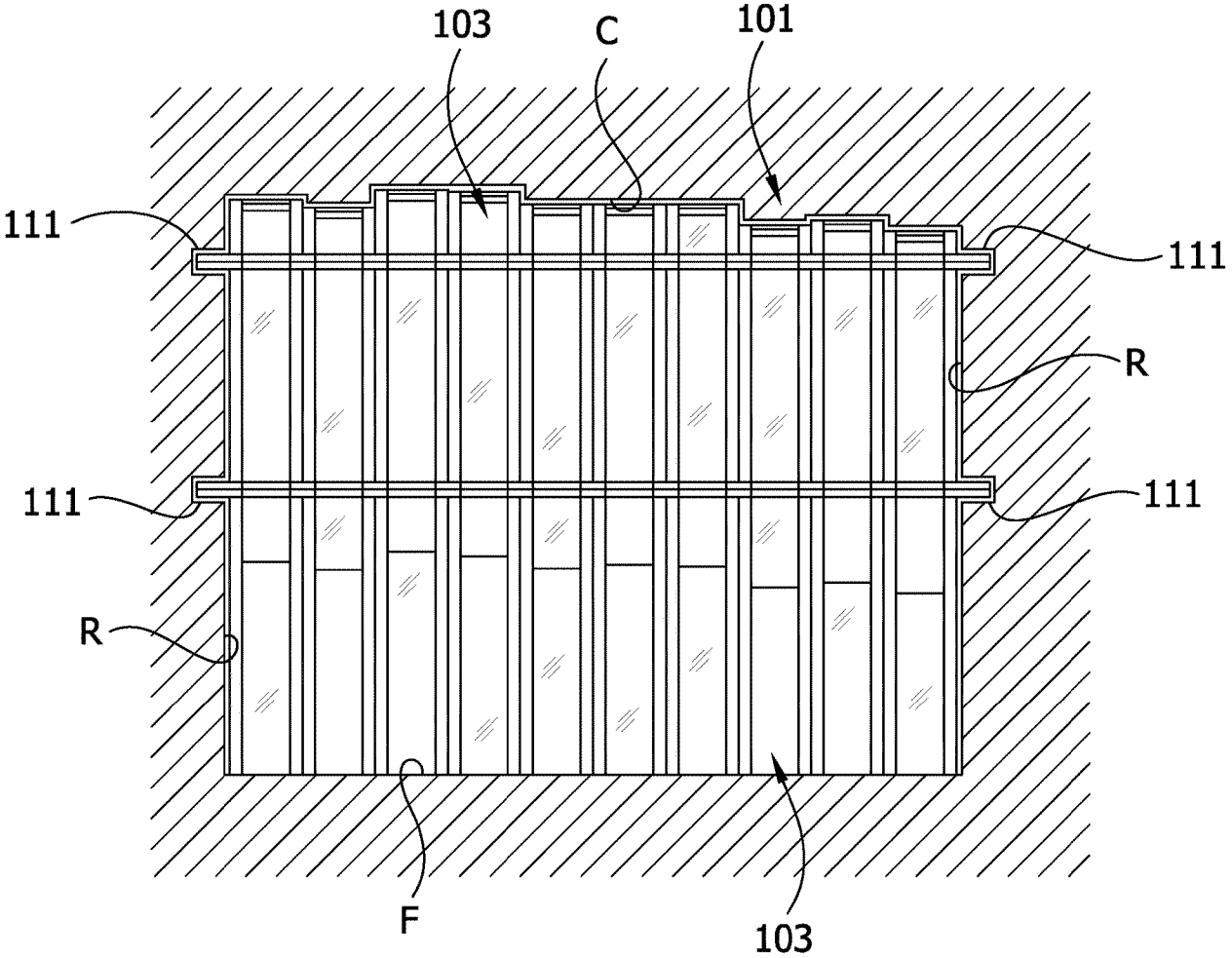
FIG. 1 is a front elevation of one embodiment of a mine stopping installed in a mine passage.
Figure 2:
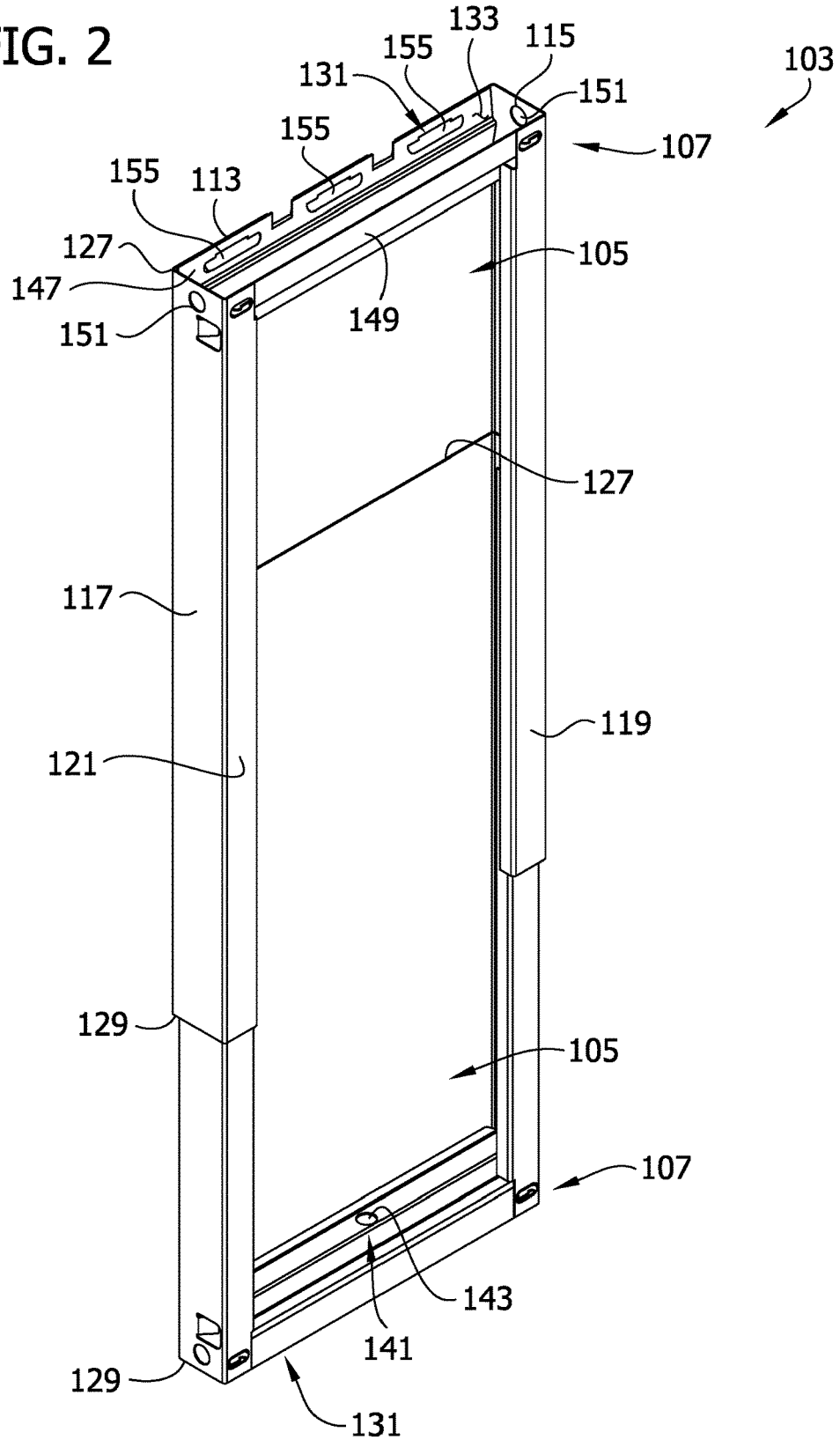
FIG. 2 is a perspective of one embodiment of a telescoping panel for making a mine stopping as illustrated in FIG. 1.

Referring to the drawings, one embodiment of a mine stopping, generally designated 101, is illustrated in FIG. 1. The mine stopping 101 is installed between opposing first and second mine surfaces C, F of a mine passage to seal the passage. The mine stopping 101 is made of a plurality of telescoping panels 103 arranged in substantially side-by-side relation to one another. Referring to FIG. 2 the telescoping panels 103 suitably include upper and lower panel members 105 configured for telescoping movement relative to one another. The panel members 105 are suitably substantially identical except that one of the panel members (e.g., the lower panel member as illustrated in FIG. 2) is slightly smaller than the other so two panels members can fit together for telescoping movement. Also, the panel members 105 have end formations 107 at one end of the panel that are configured to engage an end cap 131 and the lower panel member is inverted relative to the upper panel member so the end formations 107 are on opposite ends of the telescoping panel 103.

Referring to FIG. 1, the telescoping panels 103 of the mine stopping 101 are suitably arranged generally side-by-side so they collectively extend horizontally substantially all the way between ribs R of the mine at opposite sides of the mine passage. Each of the telescoping panels 103 suitably also extends vertically substantially all the way from the floor F of the mine passage to the ceiling C of the mine passage. The mine stopping 101 thereby blocks, or at least obstructs, flow of air through the mine passage. The panels 103 in FIG. 1 are suitably secured to a pair of generally horizontal supports 111 (e.g., using twist clamps or other suitable fasteners), which extend laterally between the ribs R. Additional information about holding telescoping mine stopping panels in side-by-side relation is provided in U.S. Pat. Nos. 4,483,642 and 7,267,505, the entire contents of which are hereby incorporated by reference. In the embodiment illustrated in FIG. 1, all of the telescoping panels 103 of the stopping 103 are substantially identical. Thus, the detailed description of one of the panels 103 below will suffice to describe all of the panels in the stopping 101. However, it is understood that one or more of the panels of the stopping may differ from the panel 103 described below.

The telescoping panels 103 facilitate erecting the mine stopping 101 in a mine passage in which the ceiling C and/or floor F may be uneven and facilitate erecting the mine stopping 101 in passages having different heights because the lengths of the telescoping panels 103 can be easily adjusted using the telescoping action of the panels 103. However, if the telescoping action of the telescoping panels 103 is not needed, the mine stopping can be formed from a plurality of non-telescoping panels such as by using only a single panel member 105 for each panel, e.g., modified so the end formations 107 for engaging the end cap 131 are on both ends of the single panel member.

Figure 3:
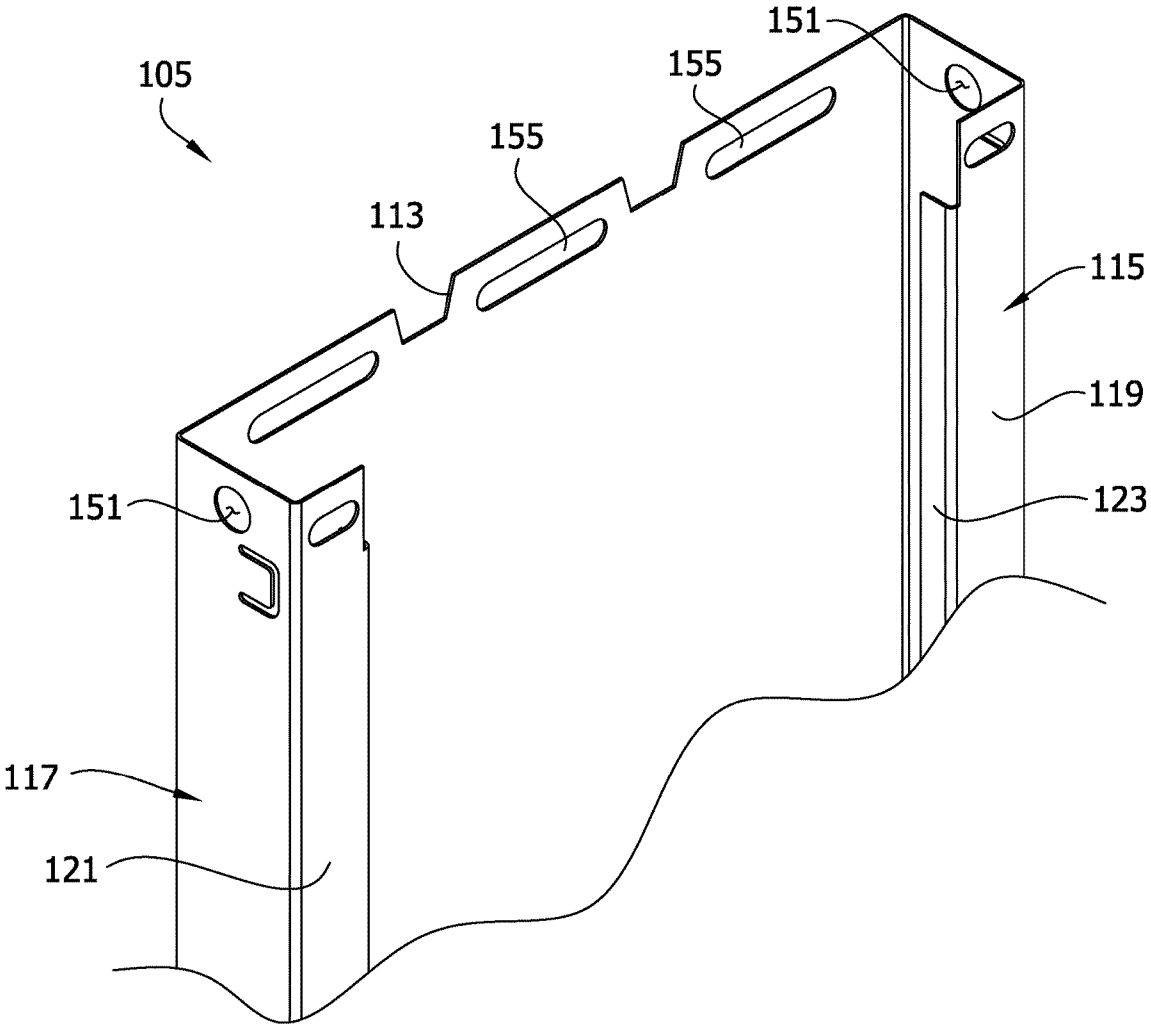
FIG. 3 is an enlarged perspective of a portion of a panel member of the telescoping panel illustrated in FIG. 2.
Figure 4:
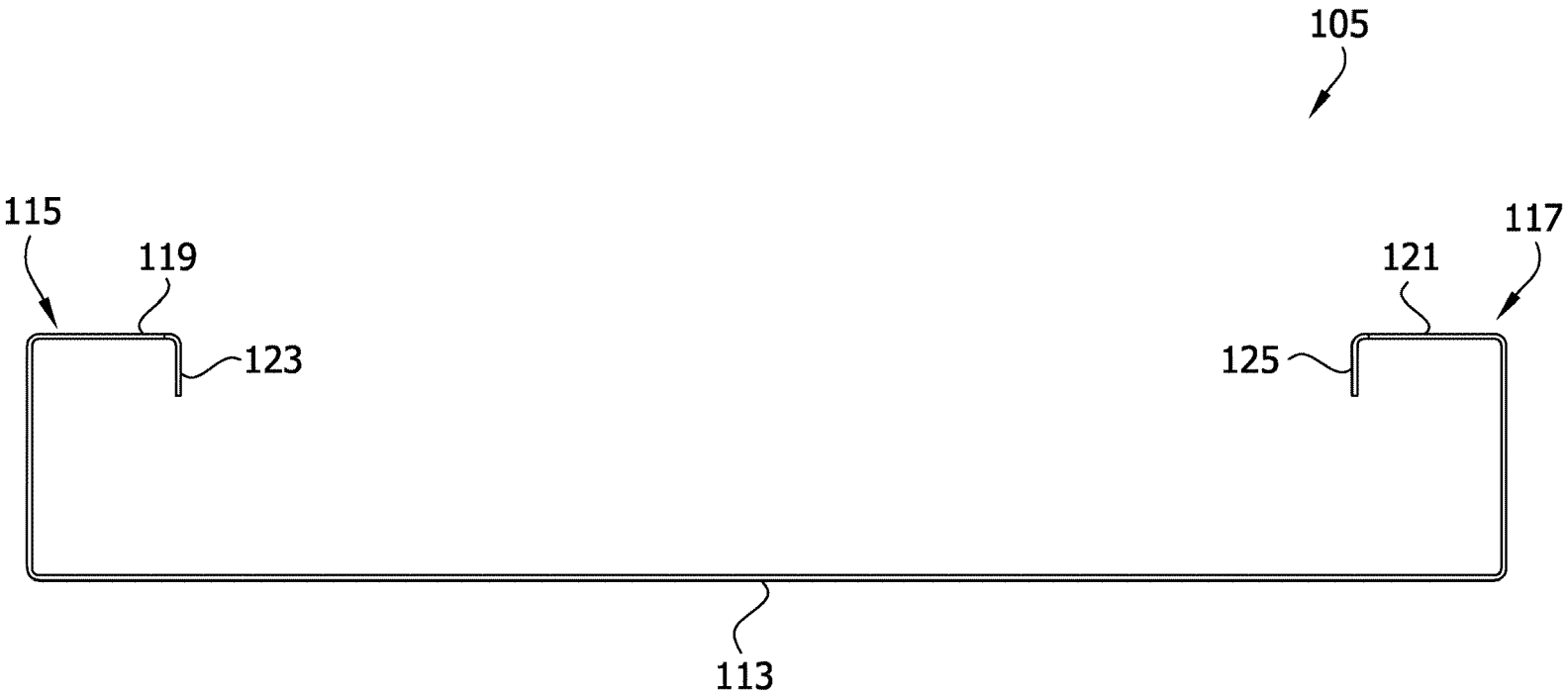
FIG. 4 is an enlarged top view of the panel member illustrated in FIG. 3.

The panel members 105 are suitably channel-shaped. Referring to FIGS. 3 and 4, for example, the panel member 105 has a web 113 and a pair of flanges 115, 117 at opposite lateral sides of the web. Except as noted herein, the web 113 and flanges 115, 117 suitably extend substantially continuously all the way along the length of the panel member 105 between its upper and lower ends 127, 129 (FIG. 2). Referring again to FIGS. 3 and 4, each of the side flanges 115, 117 in this embodiment has an in-turned portion 119, 121 at its outer edge extending generally parallel to the web 113 of the panel member 105. Each of the side flanges 115, 117 also has a lip 123, 125 at the inner edge of the respective in-turned portion 119, 121 extending toward the web 113. The panel member 105 is suitably formed by bending a single piece of sheet metal. However, other constructions are within the broad scope of the invention.

Referring to FIG. 2, an end cap 131 is attached to the panel member 105 adjacent at least one of the upper and lower ends 127, 129. For example, in FIG. 2 an end cap 131 is attached to each panel member 105 of the telescoping panel 103, with one end cap secured to the upper end 127 of the upper panel member and another end cap secured to the lower end 129 of the lower panel member. However, it is recognized that only a single end cap 131 can be secured to one or more panels 103 if desired. Various means of securing the end caps 131 to the panel members 105 can be used within the scope of the invention. For example, spot welds can be used to weld the end caps 131 to the respective panel members 105. Various fasteners known to those skilled in the art could also be used instead of or in combination with welding. Further, louvered connections 155 between the panel members 105 and the end caps 131, e.g., as disclosed in commonly-owned U.S. patent application Ser. No. 14/658,994, the entire contents of which are hereby incorporated by reference, can be used to secure the end caps to the panel members.

FIGS. 6-9 illustrate one embodiment of an end cap 131 that can be used with the panel members 105. The end cap 131 suitably has a base wall 145 and a pair of sidewalls 147, 149 on opposite sides of the base wall. The end cap 131 defines a cavity 133 between the sidewalls 147, 149 for receiving an injectable foam material 135 (see FIGS. 18A-18C). Referring to FIG. 2, when secured to the panel member 105, the end cap 131 is positioned between the first and second flanges 115, 117 of the panel member 105 adjacent an inner surface of the web 113 of the panel member. For example, the first side wall 147 extends from the base wall 145 adjacent the web 113 of the panel member 105. The second side wall 149 is spaced from the first side wall 147 in a direction away from the web 113 and is located adjacent the in-turned portions 119, 121 and lips 123, 125 of the flanges 115, 117 of the respective panel member 105. The first side wall 147 and second side wall 149 are on an opposite sides of the cavity 133. The end cap 131 is configured so the cavity 133 is generally an open-sided channel oriented so the open side of the channel faces outward from the end of the mine stopping panel 103 and the closed side of the channel faces inward from the end of the mine stopping panel. When the end cap 131 is secured to the panel member 105 as illustrated in FIG. 2 and the telescoping panel 103 is positioned so it extends between the floor F and the ceiling C of the mine passage (as in FIG. 1), the open side of the channel-shaped cavity 133 is adjacent the floor or ceiling of the mine passage, allowing injectable foam material 135 in the cavity to engage the floor or ceiling to form a seal between the end 107 of the panel member 105 and the mine passage.

The telescoping panel 103 also has an injection inlet 141 for injecting the foam material 135 into the cavity 133 while the open side of the channel-shaped cavity is blocked by the floor F or ceiling C of the mine passage. For example, the injection inlet is suitably formed in the end cap 131. In the embodiment illustrated in FIGS. 2 and 6-9, the injection inlet 141 is an opening 143 (e.g., a substantially circular opening) in the base wall 145 of the end cap 131. The injection inlet opening 143 is suitably in the range of about ¼ inch to about ⅝ inch in diameter. However, the size of the injection inlet 141 can vary from this without departing from the scope of the invention. This configuration of the injection inlet 141 facilitates injection of the foam material 135 into the cavity 133 from a location above the bottom and/or below the top of the end cap 131. For example, in a mine passage having a high ceiling C, this configuration might be desirable so a worker reaching upward can more easily reach the injection inlet 141. Likewise, the injection inlet 141 at the lower end of the panel 103 may be accessed relatively easily by a worker reaching down toward the floor F.

Figure 10:
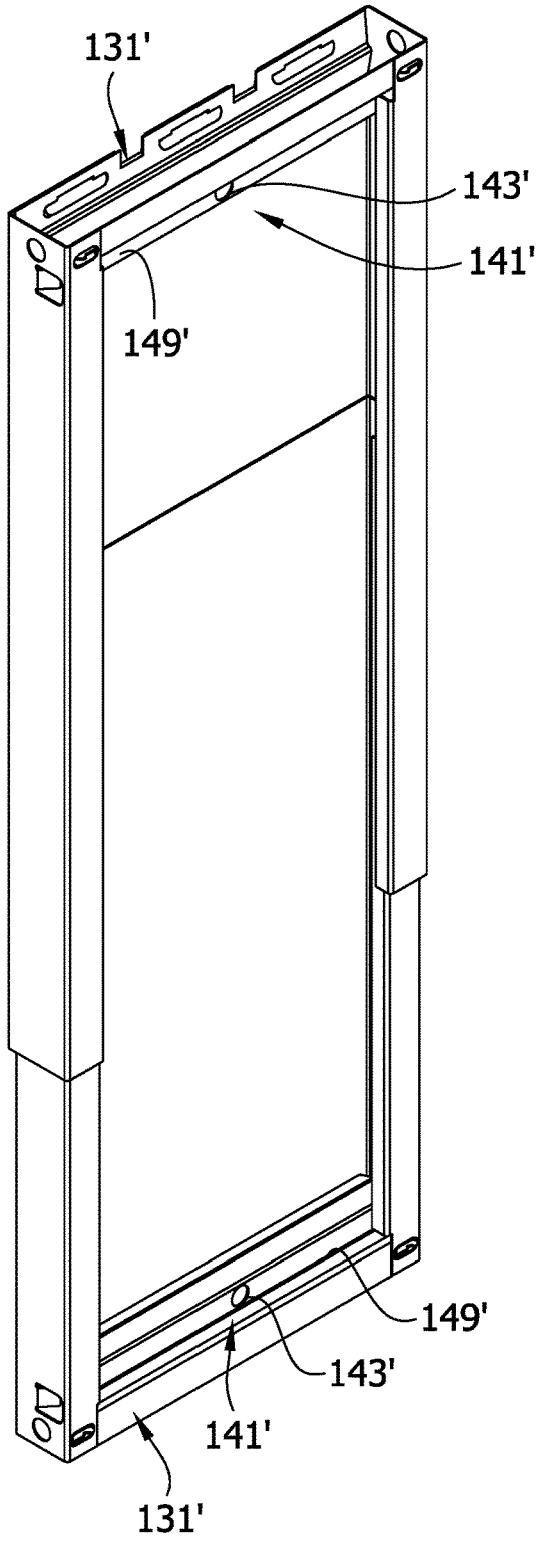
FIG. 10 is a perspective of another embodiment of a telescoping panel for making a mine stopping as illustrated in FIG. 1.
Figure 11:
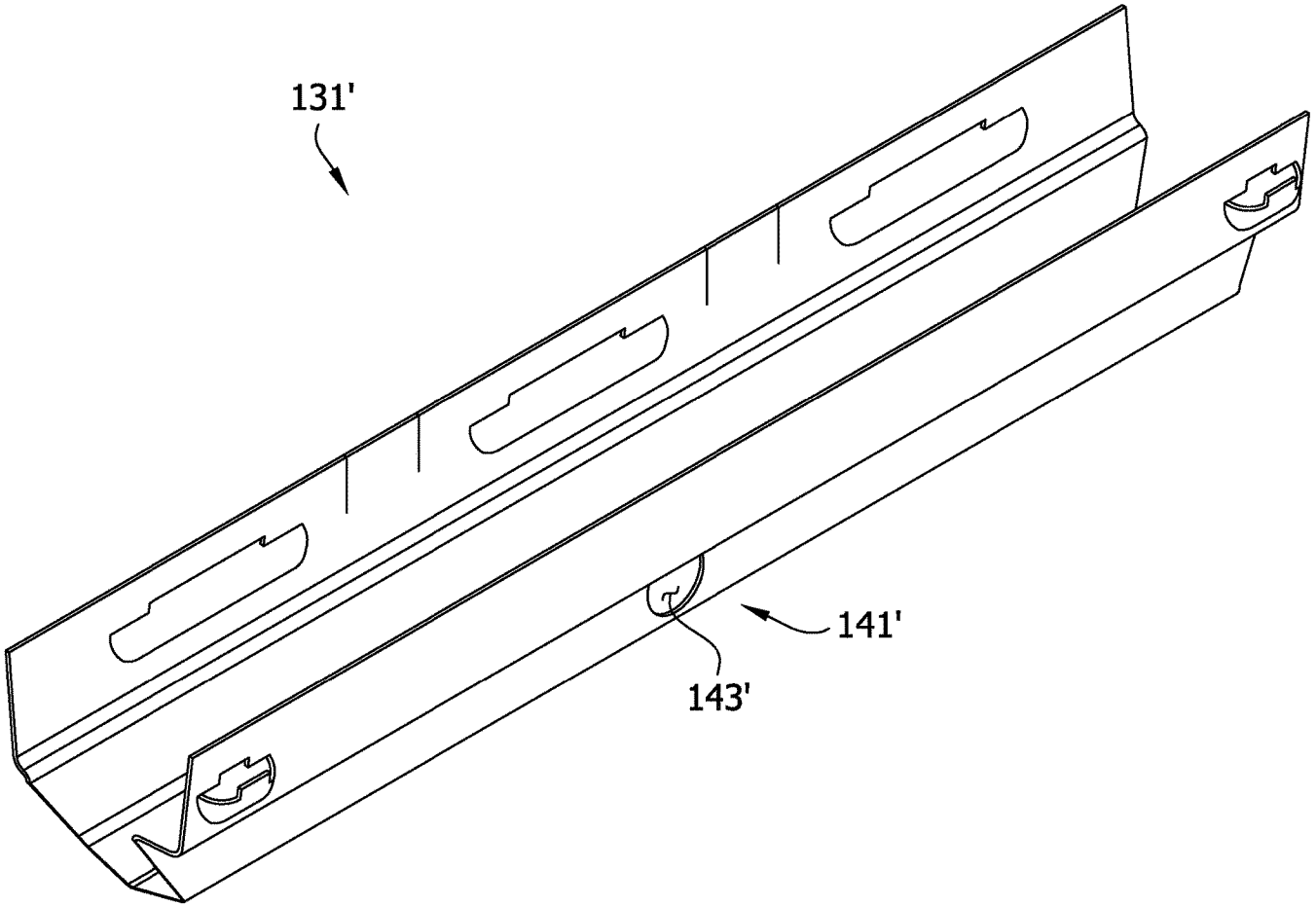
FIG. 11 is a perspective of an end cap of the telescoping panel illustrated in FIG. 10.
Figure 12:
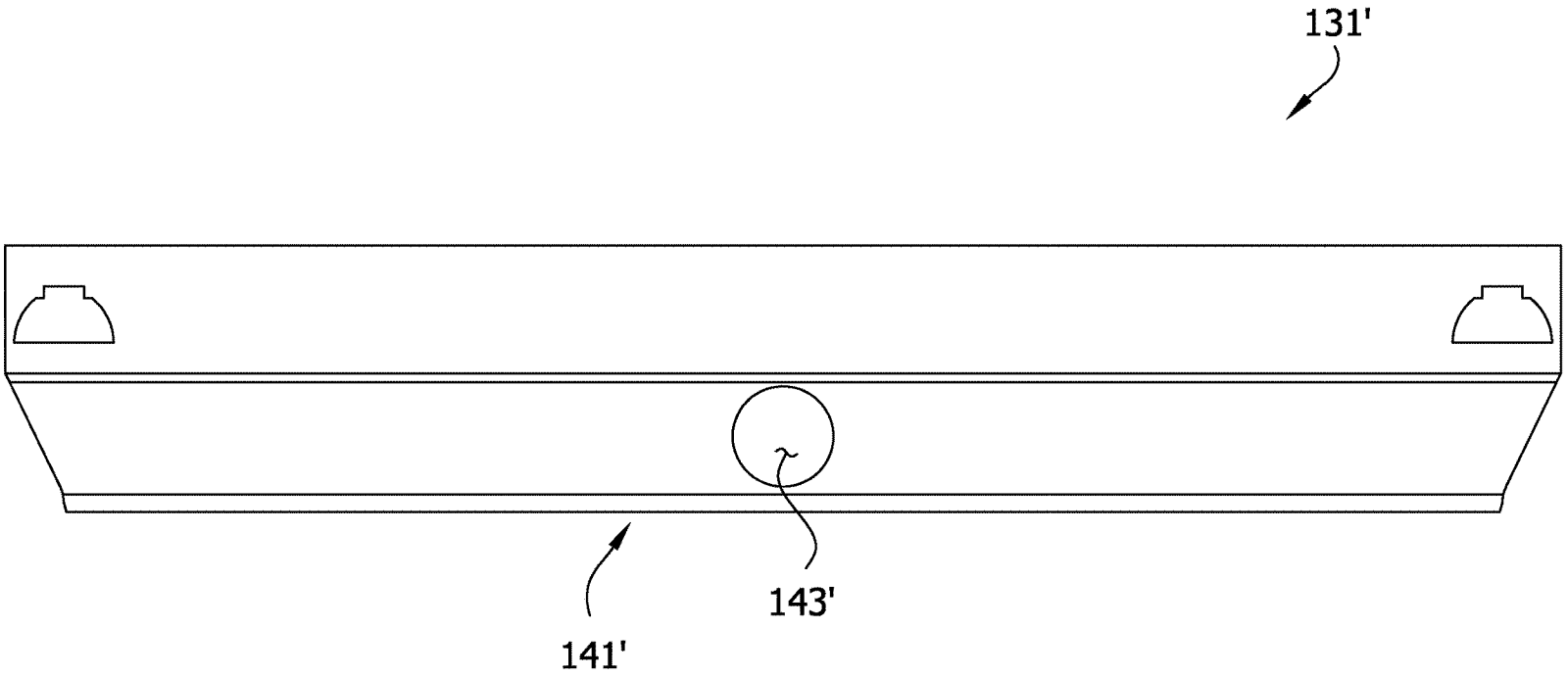
FIG. 12 is a front elevation of the end cap illustrated in FIG. 11.

Alternatively, as illustrated in FIGS. 10-12, the injection inlet 141' is suitably an opening 143' formed in the side wall 149' of the end cap 131' that is on the opposite side of the cavity 133 from the web 113 of the panel member 105. This configuration of the injection inlet 141' facilitates injection of foam material 135 into the cavity 133 from a location at about the same elevation as the end cap 131'. For example, it might be desirable to use this configuration of the injection inlet 141' when the ceiling C of the mine passage is relatively low to avoid the need for a worker to stoop down to access the injection inlet 141' at the upper end of the panel 103.

Figure 13:
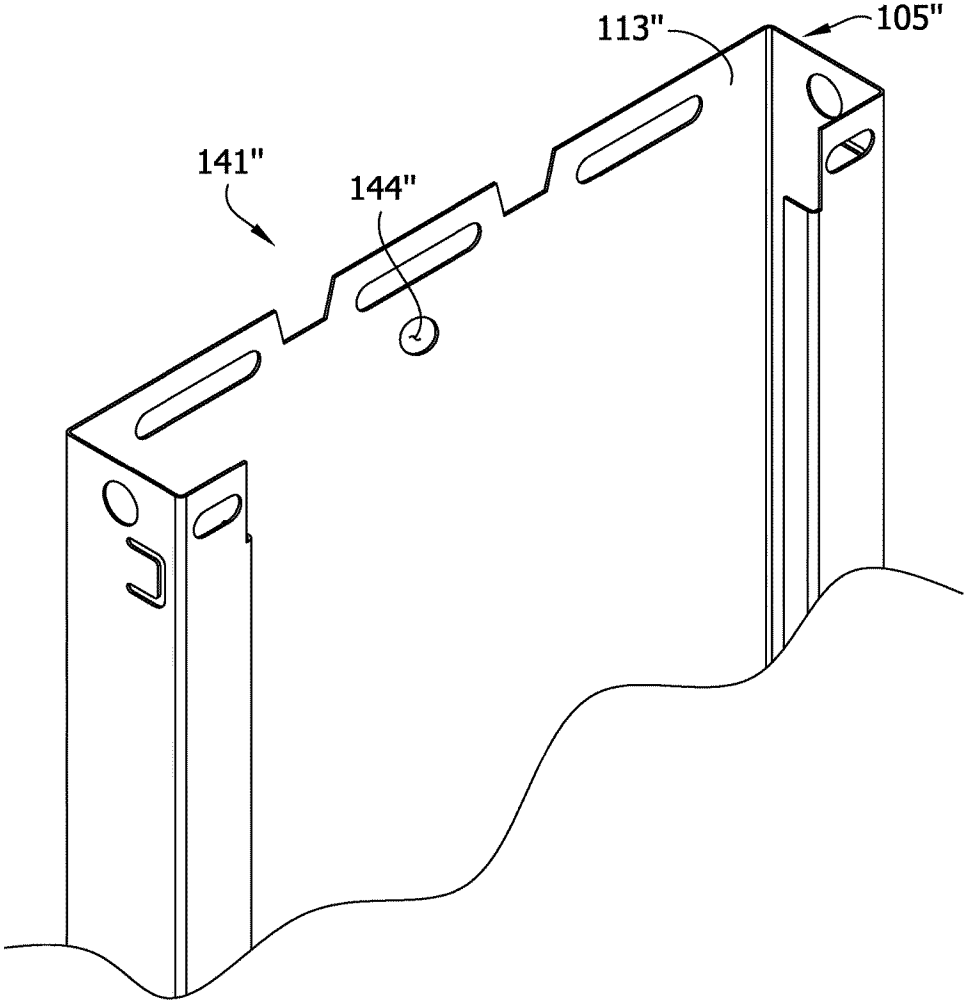
FIG. 13 is an enlarged perspective of another embodiment of a panel member.
Figure 14:
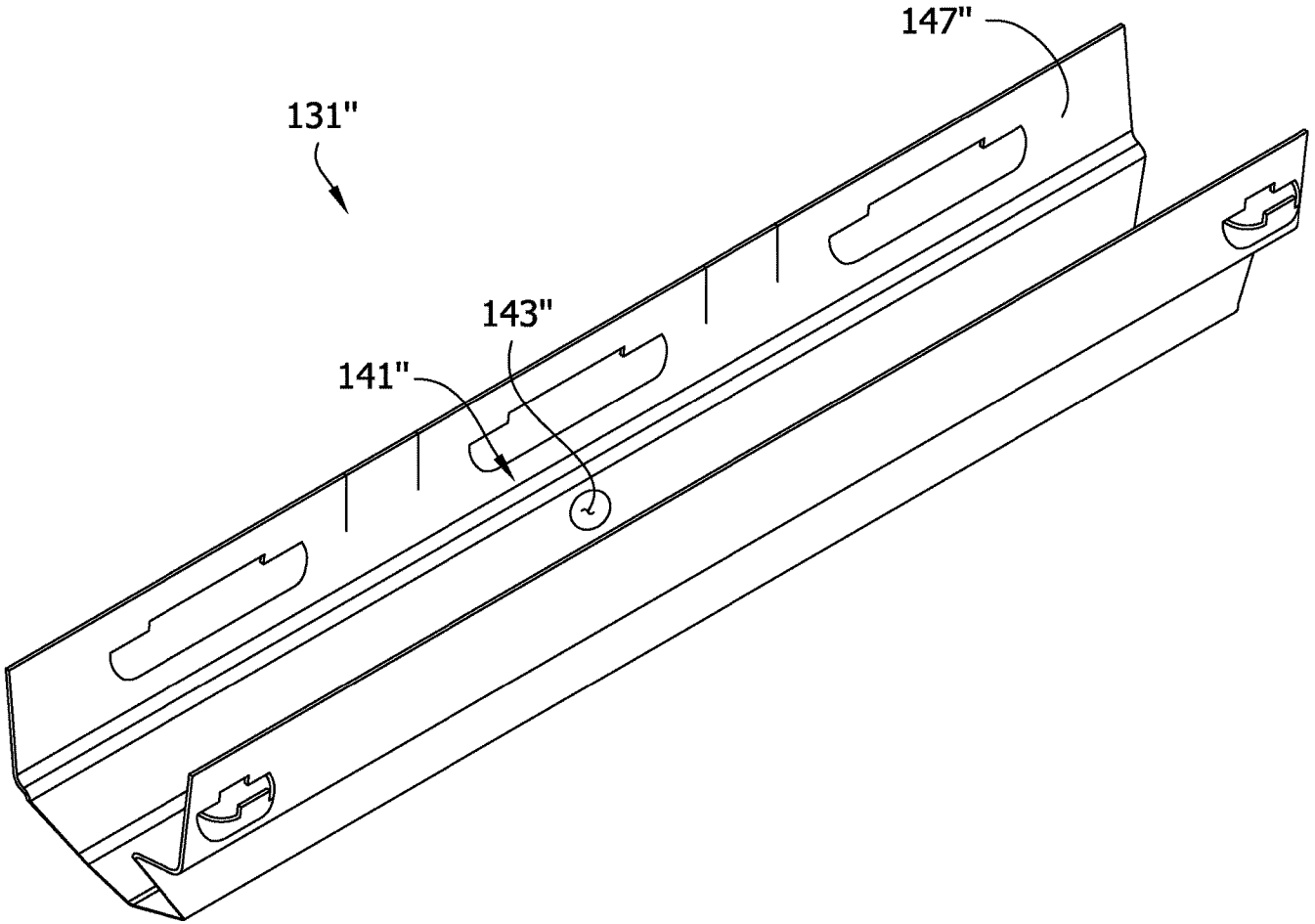
FIG. 14 is a perspective of another embodiment of an end cap, which is suitable for use with the panel member illustrated in FIG. 13.
Figure 15:
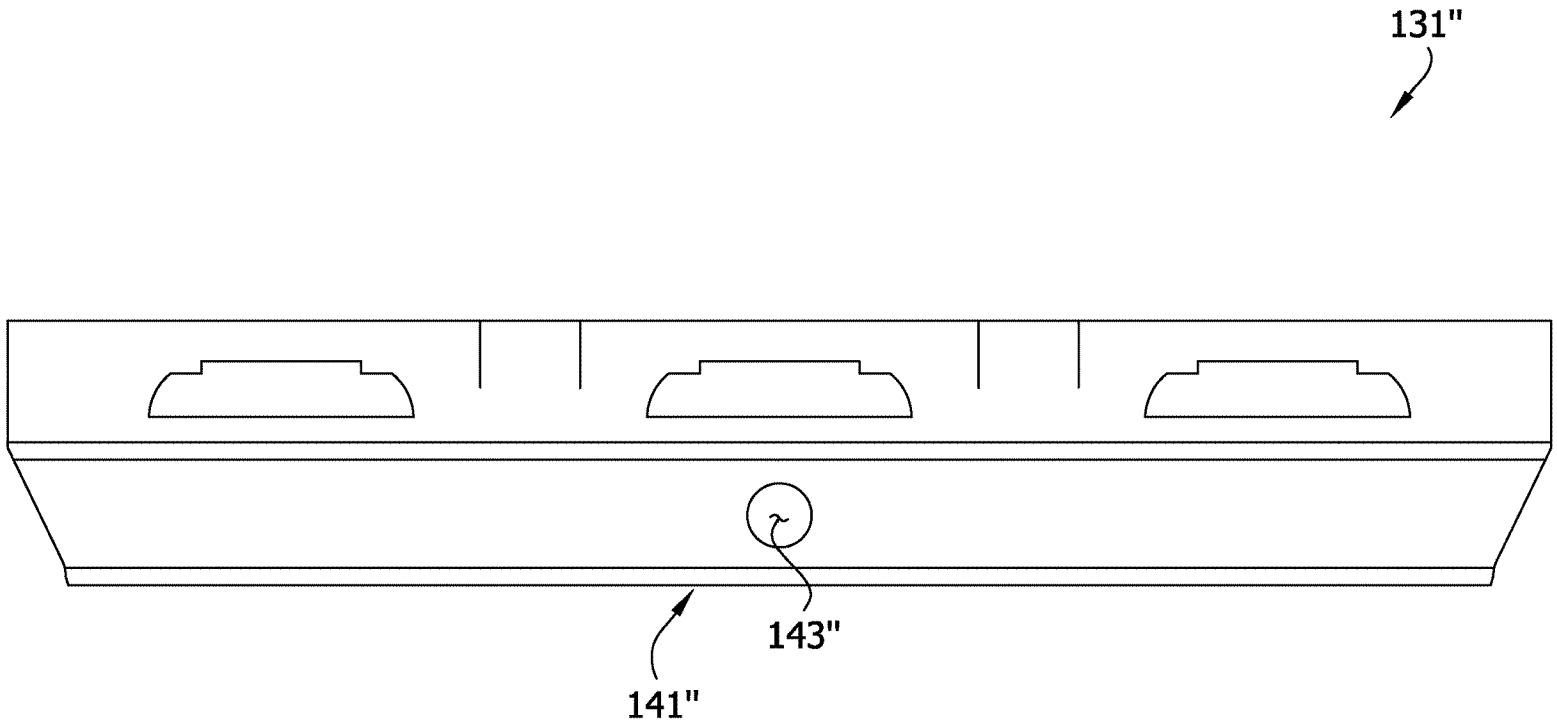
FIG. 15 is a rear elevation of the end cap illustrated in FIG. 14.

FIGS. 13-15 illustrate still another possible configuration of the injection inlet 141". In this embodiment, the injection inlet 141" includes an opening 143" in the sidewall 147" of the end cap 131" that is adjacent the web 113" of the panel member 105". This injection inlet 141" also includes an opening 144" in the web 113" of the panel member 105" that is positioned to be aligned with the opening 143" in the end cap 131" when the end cap is secured to the panel member. This configuration of the injection inlet 141" facilitates injection of the foam material 135 into the cavity 133 from the opposite side of the panel member and the telescoping panel 103 compared to the injection inlet 141 illustrated in FIGS. 2 and 6-9.

Figure 16:
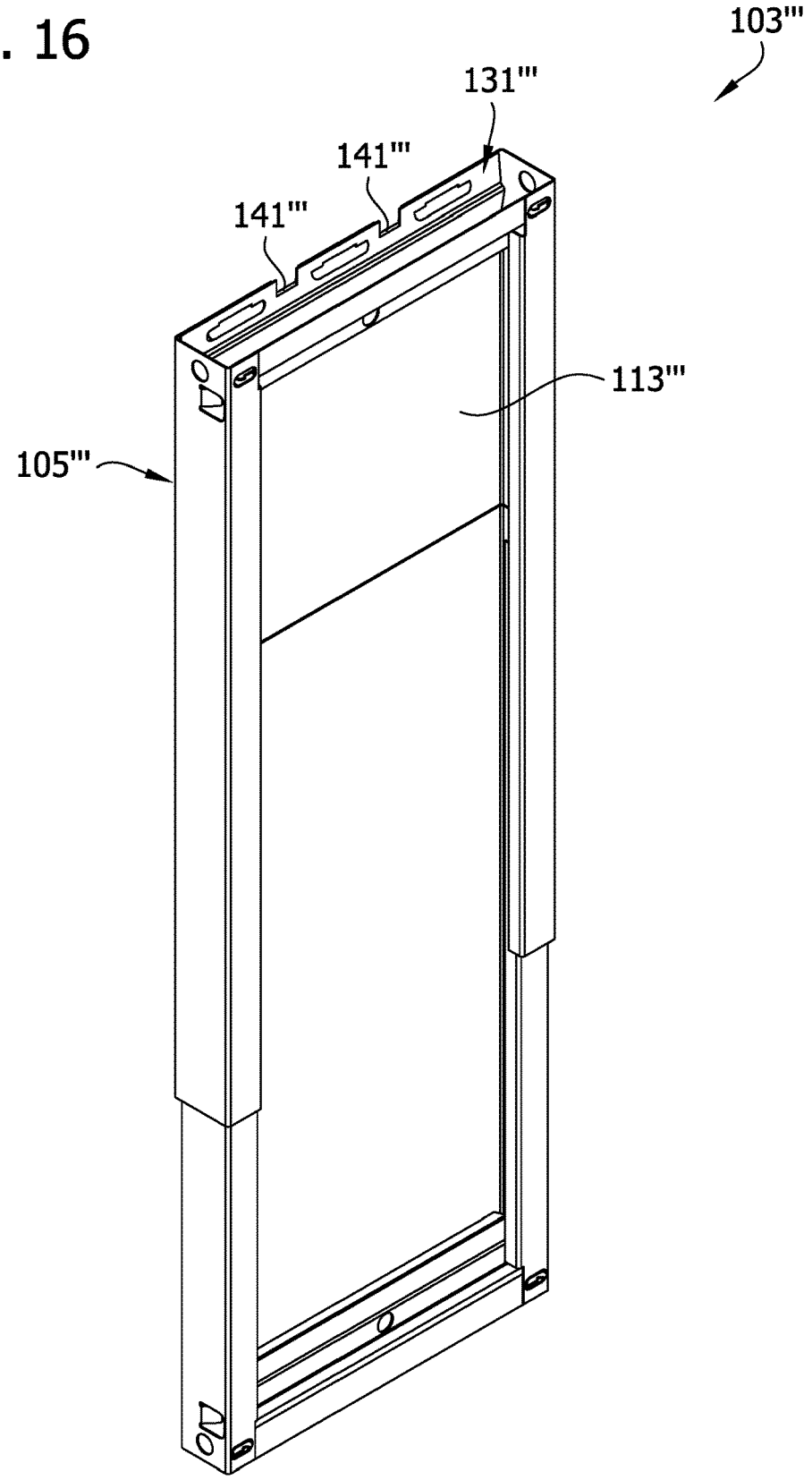
FIG. 16 is a perspective of another embodiment of a telescoping panel for making a mine stopping.
Figure 17:
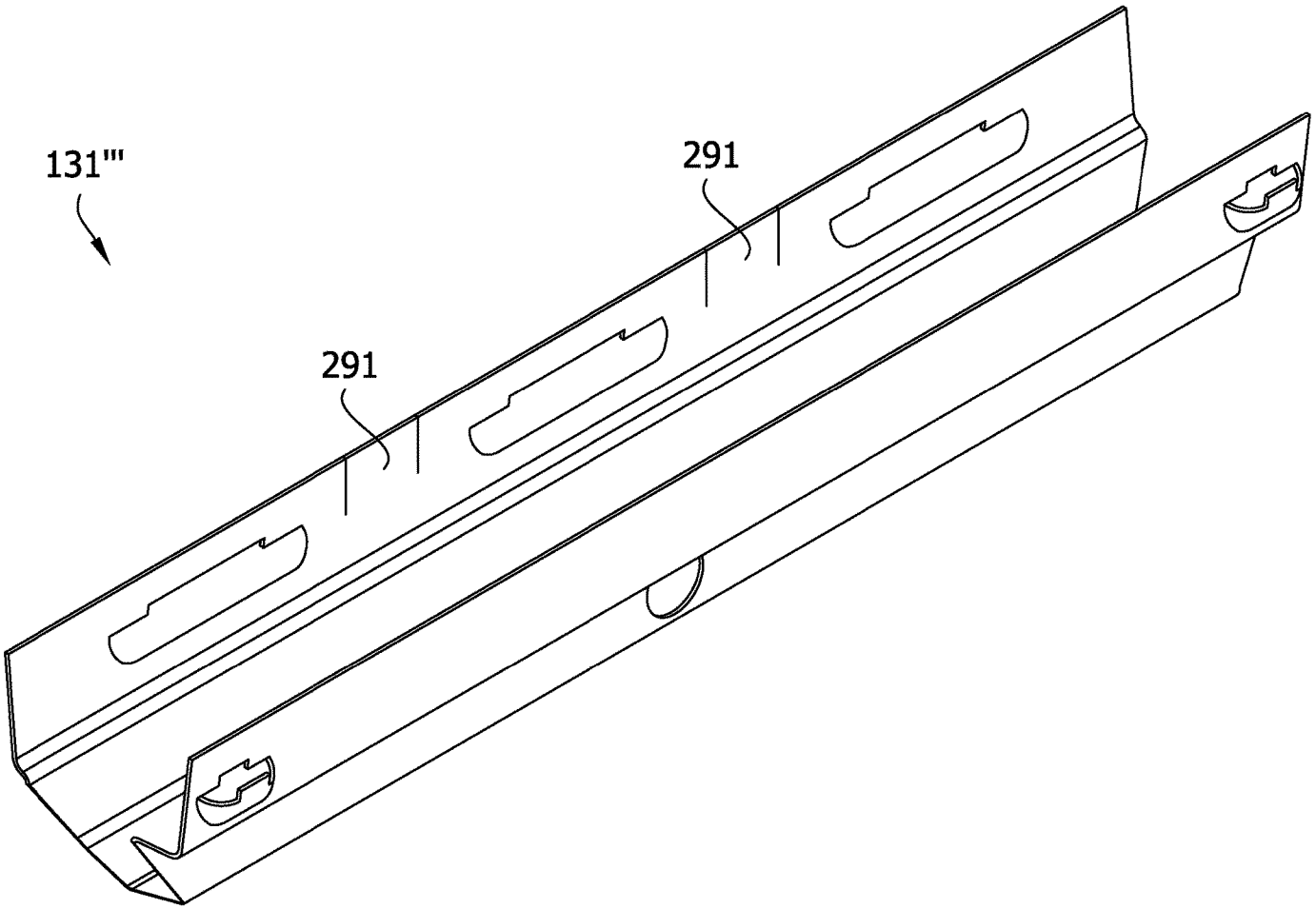
FIG. 17 is a perspective of another embodiment of an end cap suitably for use with the telescoping panel illustrated in FIG. 16.

Referring to FIG. 16, another possible configuration of the injection inlet is a notch 141''' extending vertically from the upper or lower end of the web 113''' of the panel member 105''' and the sidewall 147''' of end cap 131''' that is adjacent the web. In FIG. 16, there are a pair of such notches 141''' illustrated in the upper end of the panel member 105'''. Corresponding notches (not shown) are suitably also on the lower end of the panel 103'''. The notches 141''' are suitably associated with folding tabs 291 (FIG. 17) on the end cap 131''' that are folded over the edge of the panel member 105''' at the notches to limit vertical movement of the end cap relative to the panel member. Additional information about the use of tabs to limit movement of the end cap relative to the panel member is provided in commonly-owned U.S. application Ser. No. 14/658,994, the entire contents of which are hereby incorporated by reference.

The injection inlets 141, 141', 141", 141''' are suitably spaced from the flanges 115, 117 by a distance of at least about 2 inches. For example, the injection inlets 141, 141', 141", 141''' are suitably positioned within a central portion of the panel 103 that spans about 50% of the width of the panel. In the embodiments illustrated in the drawings, the injection inlets 141, 141', 141", 141''' are positioned substantially in the middle of the respective panels 103. It may be desirable in some cases to have distance between the injection inlet 141, 141', 141", 141''' and the side of the panel 103 so that the foam material has some time to expand and partially set up before reaching the side of the panel, especially in cases in which the foam material is in a relatively runny state when initially injected. It is understood, however, that other configurations are possible within the scope of the invention.

The injection inlets 141, 141', 141", 141''' are suitably configured to facilitate use of an injection apparatus to inject the foam material 135 into the injection inlet when the panel 103 is positioned in the mine passageway P with the upper end cap 131 adjacent the ceiling C and the lower end cap adjacent the floor F., as illustrated in FIG. 1. For example, the openings 143, 143', 143" and notch 141''' forming the injection inlets 141, 141', 141", 143''' suitably open laterally outward and/or longitudinally inward from the adjacent end of the panel. The openings 143, 143', 143", and notch 141''' for the injection inlets 141, 141', 141", 141''' on the upper end cap 131 suitably open laterally outward and/or downward. The openings 143, 143', 143", and notch 141''' for the injection inlets 141, 141', 141", 141''' on the lower end cap 131 suitably open laterally outward and/or upward. This arrangement can facilitate use of an injector (not shown) to inject foam material 135 into the injection inlets 141, 141', 141", 141''' when the ability to position the injector is restricted by the ceiling C and/or floor F. However, other configurations are possible within the broad scope of the invention.

The same panel 103 can include more than one injection inlet configuration. For example, if desired, an end cap 131 having an injection inlet 141 formed by an opening 143 in the base wall 145 of the end cap can be secured to the lower end of the telescoping panel 103 to minimize the amount of bending required of a person injecting the foam material 135 into the lower end cap. At the same time, an end cap 131' having an injection inlet 141' formed by an opening 143' in the sidewall 149' of the end cap can be secured to the upper end of the telescoping panel 103 so that a person can more easily inject foam material 135 into the upper end cap without stooping down to inject the foam through the bottom of the end cap. Other combinations of injection inlet configurations 141, 141', 141", 141''' may be desirable for various reasons. Also, the injection inlets 141, 141', 141", 141''' described herein are provided as suitable examples. It is understood other injection inlets are also within the scope of the invention.

Figure 5:
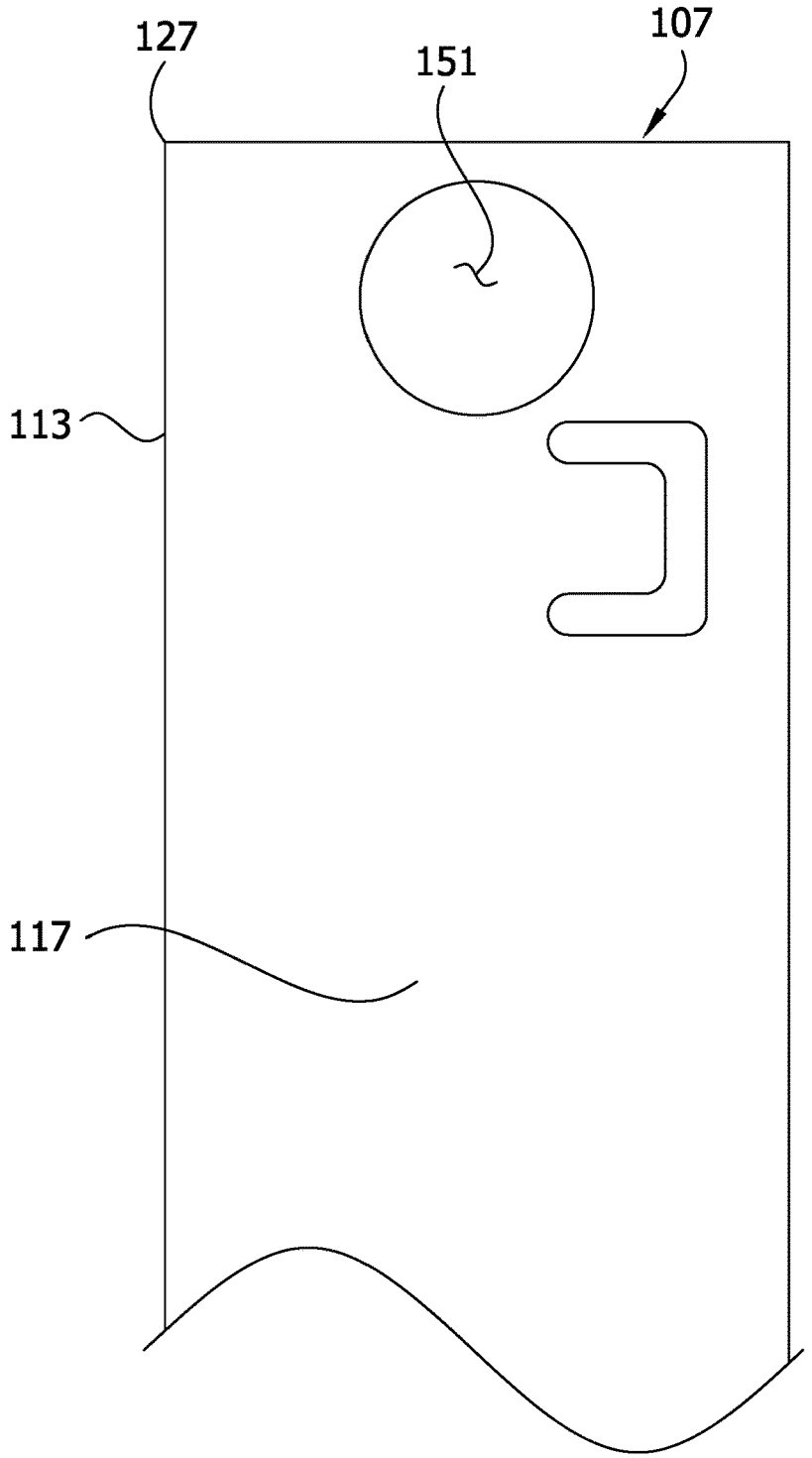
FIG. 5 is a left side elevation of the upper portion of the panel member illustrated in FIGS. 3 and 4.
Figure 6:
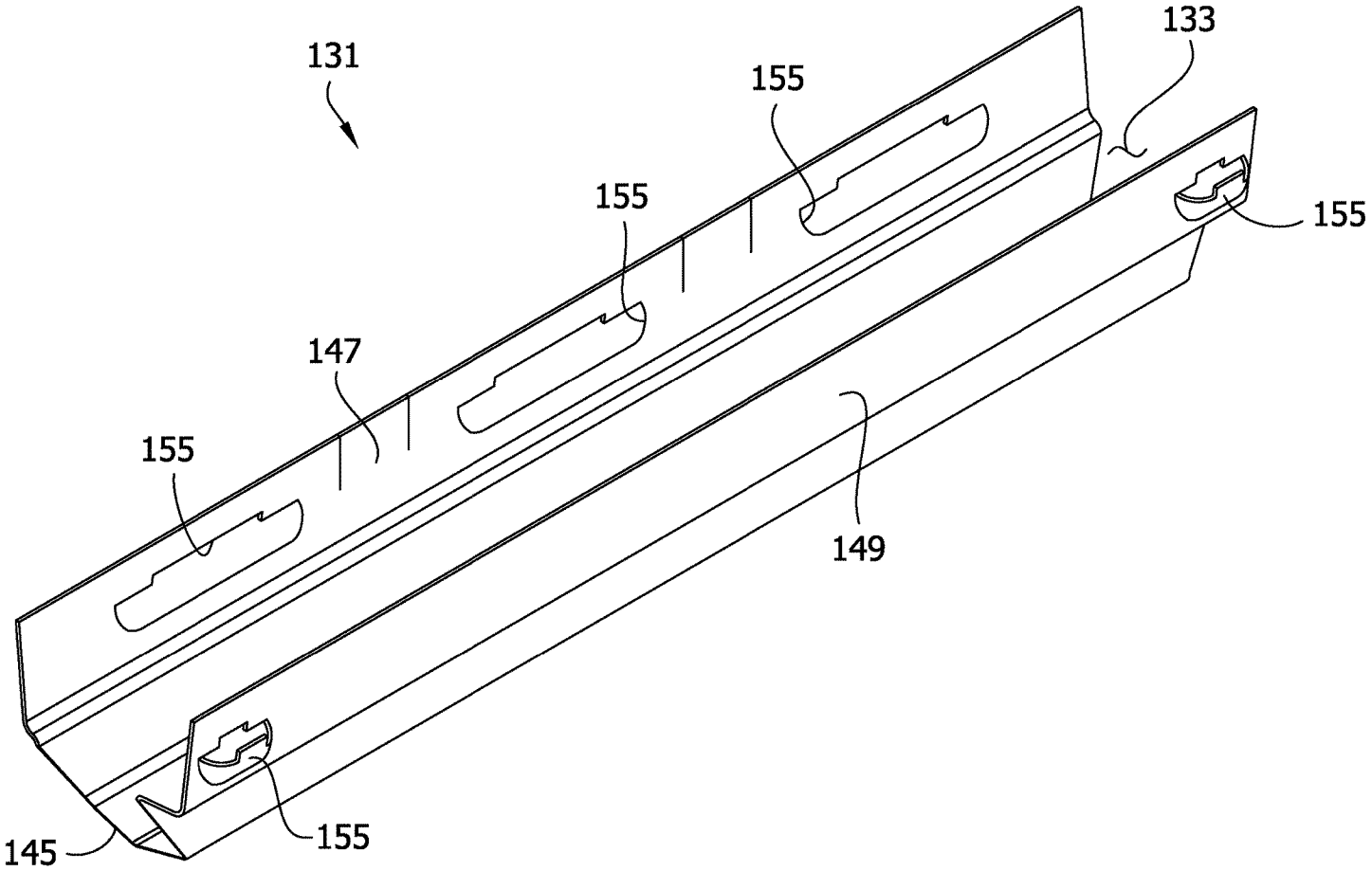
FIG. 6 is a perspective of one embodiment of an end cap of the telescoping panel illustrated in FIG. 2.
Figure 7:
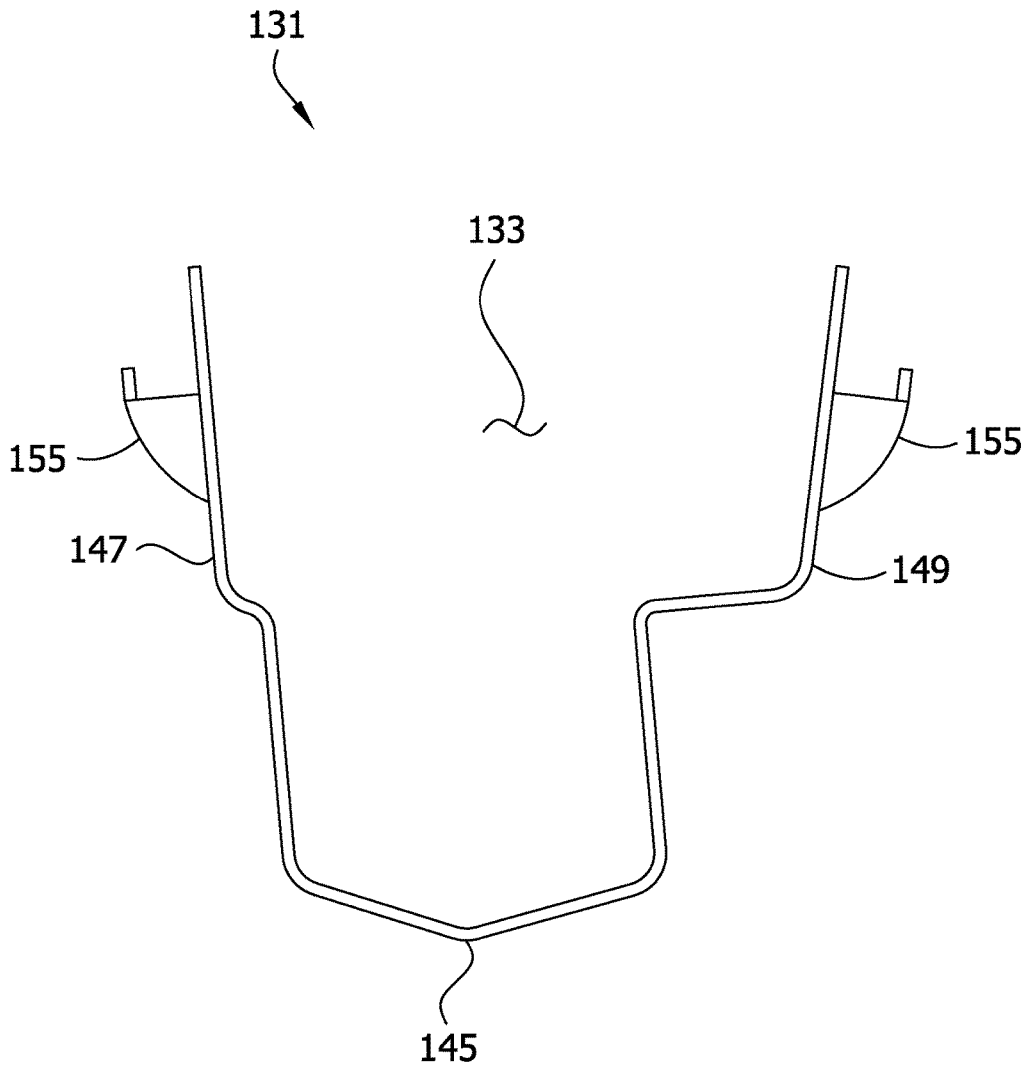
FIG. 7 is a left side elevation of the end cap illustrated in FIG. 6.
Figure 8:
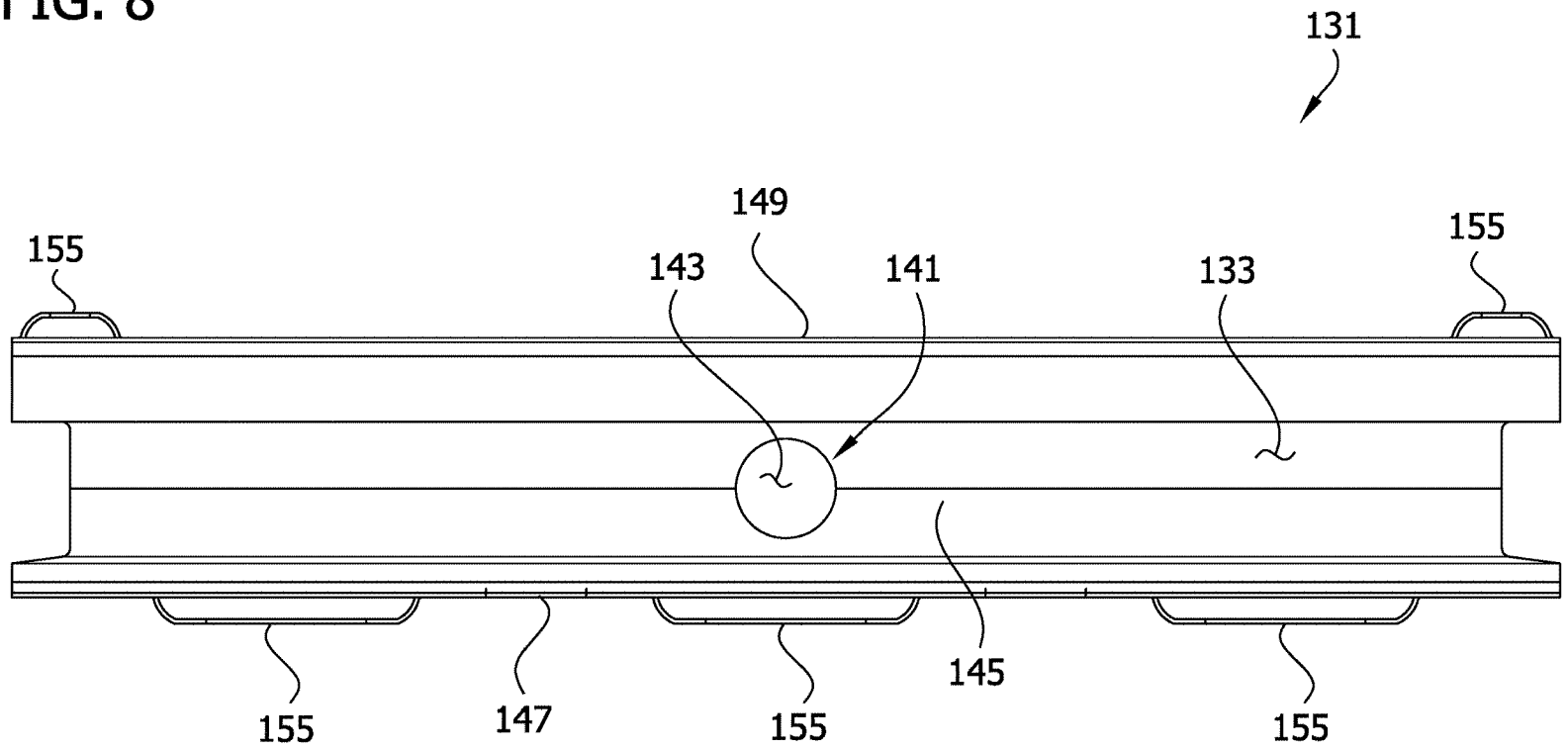
FIG. 8 is a top plan of the end cap illustrated in FIGS. 6 and 7.
Figure 9:
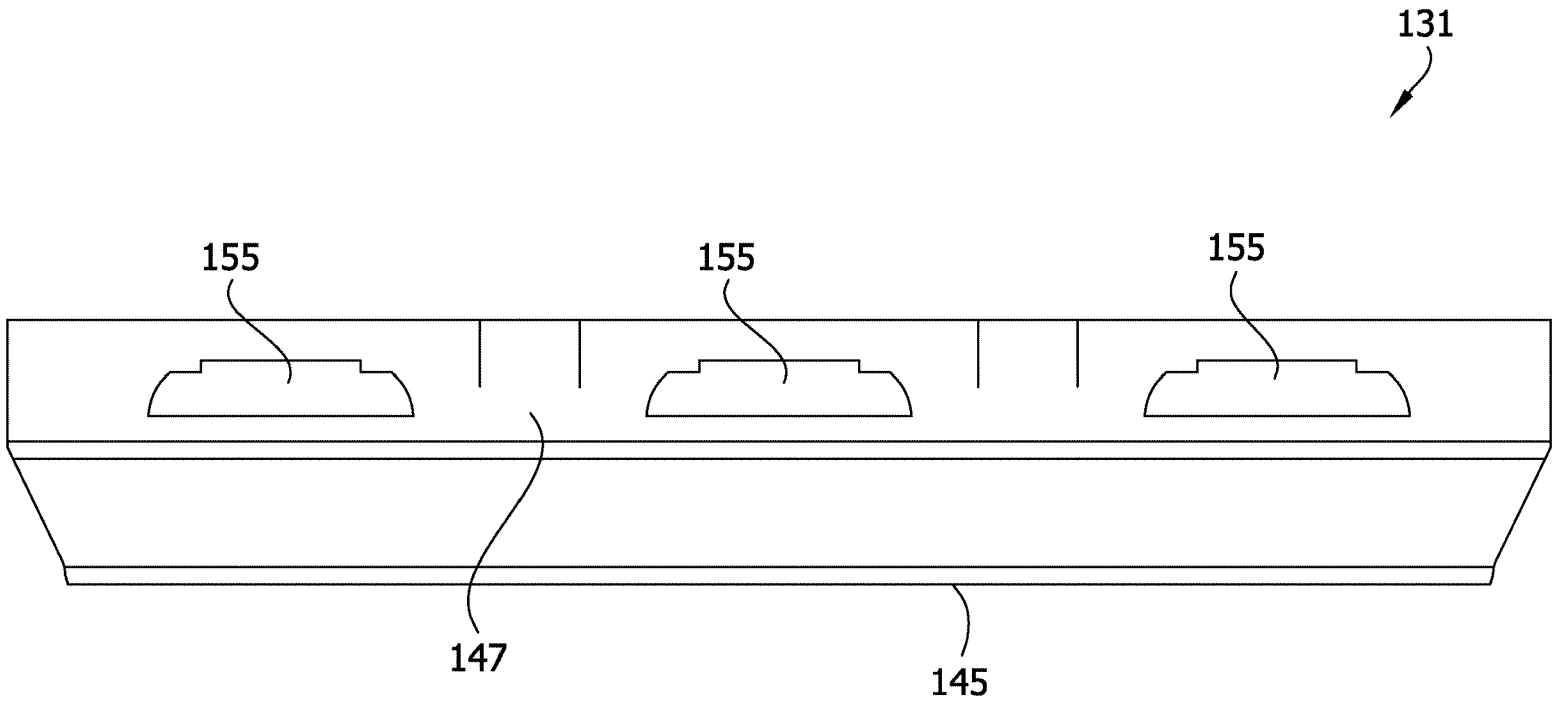
FIG. 9 is a rear elevation of the end cap illustrated in FIGS. 6-8.

Referring to FIGS. 2, 3, and 5 an opening 151 is suitably provided in at least one of the flanges 115, 117 of the panel member 105 for allowing foam material 135 injected into the cavity 133 to flow out of the cavity in a lateral direction through the opening. The openings 151 are suitably about ⅜ to about ½ inch in diameter. In FIGS. 2 and 3, each of the flanges 115, 117 has a substantially identical opening 151. Moreover, the openings 151 in the flanges 115, 117 are suitably spaced about the same distance from the web 113 of the panel member 105 and about the same distance from the adjacent end 127 or 129 of the panel member 105. In some cases, when multiple mine stopping panels 103 are positioned side-by-side to form a mine stopping 101, the openings 151 of the adjacent mine stopping panels may be aligned with each other. As used herein, adjacent openings 151 are considered aligned with one another when they in sufficiently close alignment with one another for material to flow from one opening through the other, even if there is some misalignment and/or even if not all of the material flowing out of the first opening flows through the adjacent opening. The openings 151 of adjacent mine stopping panels 103 can generally be aligned where the ceiling C and/or floor F of the mine passage are substantially flat and level. Referring to FIG. 1 for example, the floor F is substantially flat so all of the openings 151 at the lower ends of the telescoping panels 103 can easily be aligned with the corresponding openings of adjacent panels 103. The ceiling C in FIG. 1 is not as flat. However, it is still possible that the openings 151 of at least some of adjacent panels 103 can be aligned when the ceiling or floor F is not flat, such as the two telescoping panels on the left side of the mine stopping 101 in FIG. 1.

Wherever the openings 151 of adjacent panels 103 in the mine stopping 101 can be aligned, foam material 135 injected in the cavity 133 of one of the panels can flow in to the cavity of the adjacent panel through the aligned openings. This can be desirable, for instance, because it allows foam 135 to be injected into the cavities 133 of more than one panel 103 through a single injection inlet 141, 141', 141", or 141'". Moreover, when the foam material 135 extends continuously through the aligned openings 151 into the cavities 133 of more than one panel 103, the foam material can help hold the panels more securely in side-by-side relation to one another. One the other hand, wherever the openings 151 of adjacent panels 103 are not aligned, each cavity 133 can be filled using the respective injection inlet 141, 141', or 141" into the cavity. Although the foam material 135 cannot flow from one cavity 133 into the cavity of an adjacent panel 103 in this scenario, the foam material can extend through the openings 151 and contact the side flanges 115, 117 of adjacent panels 103. The foam material 135 can also fill gaps between adjacent panels 103 after flowing through the opening 151 and contacting the flange 115 or 117 of an adjacent panel. Thus, adhesive properties of the foam material 135 can help hold the panels 103 of the stopping more securely in side-by-side relation even when the openings 151 of adjacent panels 103 cannot be aligned due to uneven floors F and/or ceilings C.

Figure 18A:
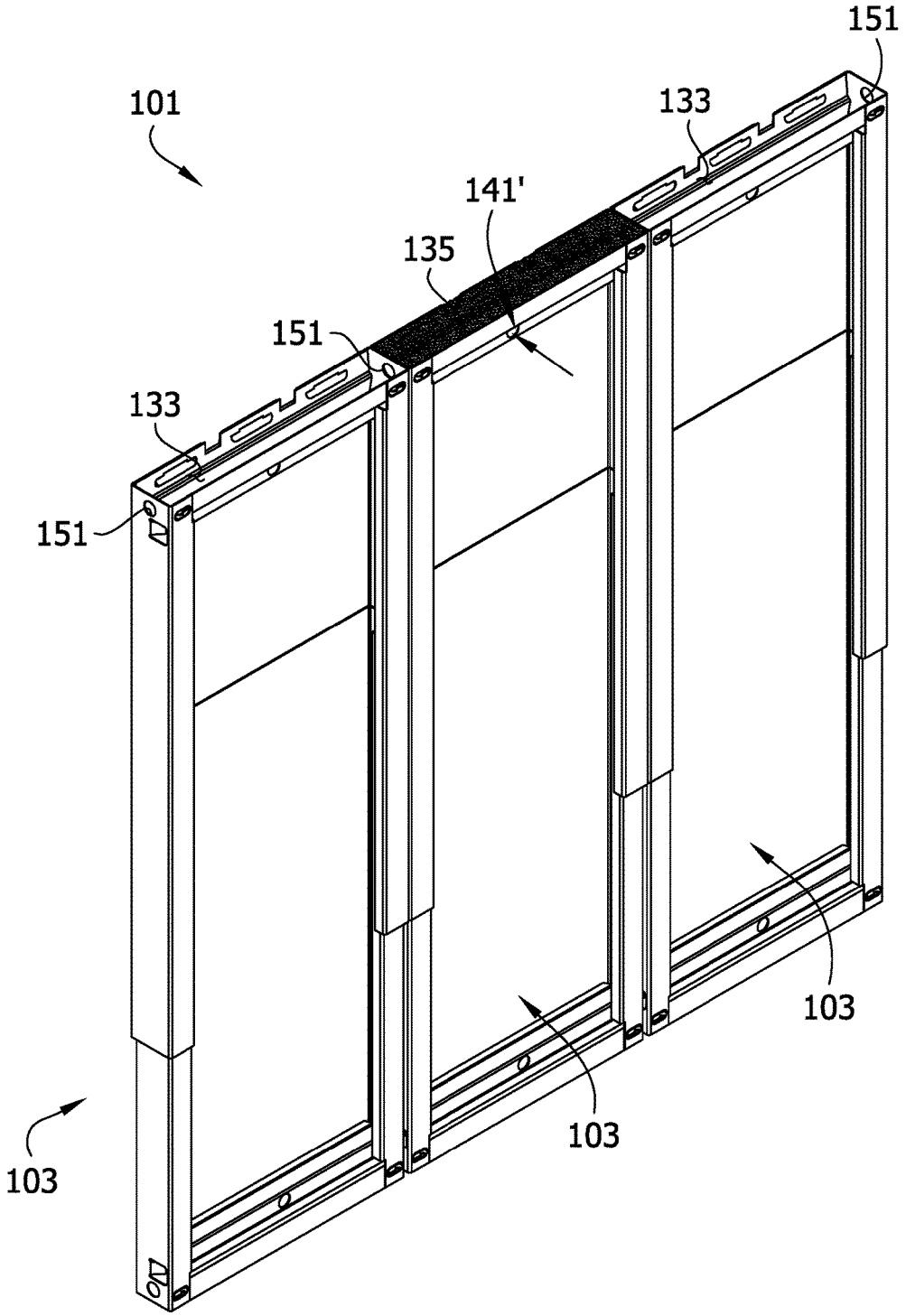
FIGS. 18A-18C are schematic illustrations of one embodiment of a method of making a mine stopping.
Figure 18B:
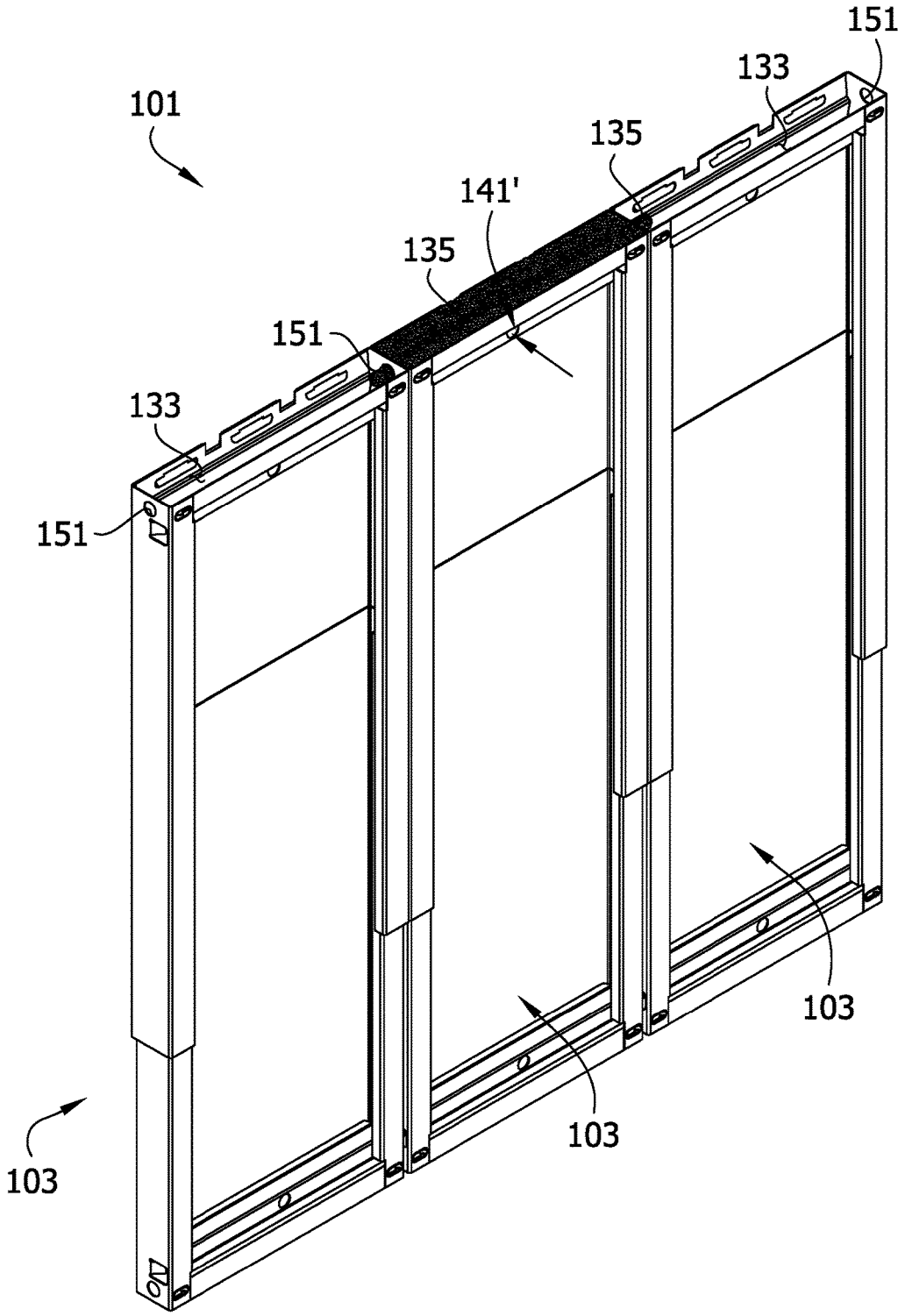
Figure 18C:
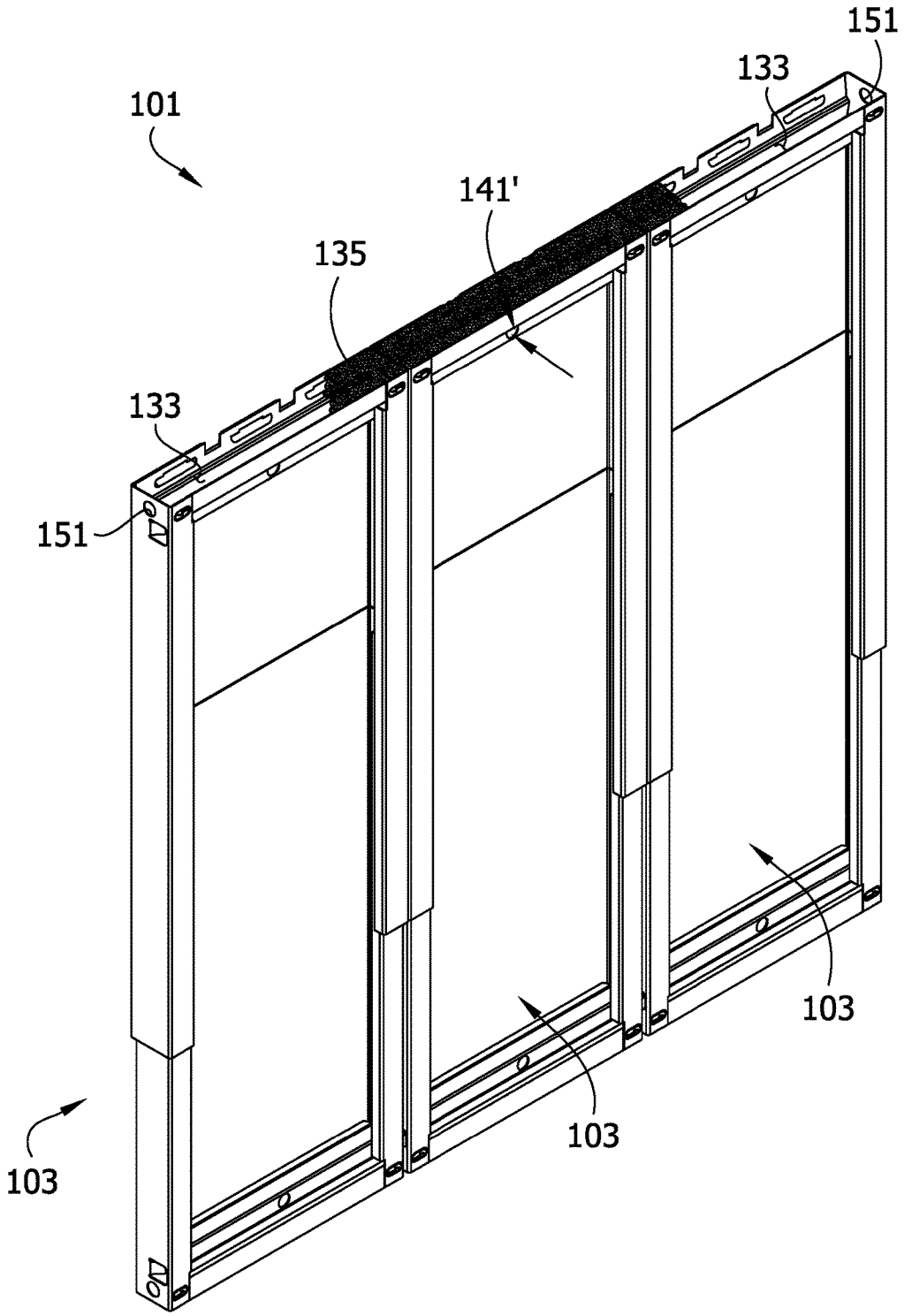

FIGS. 18A-18C illustrate one embodiment of a method of sealing a mine passage with a stopping 101 using one or more of the panels 103 described above. The method includes arranging a plurality of the mine stopping panels, including at least one panel 103 as described above, and more suitably multiple panels 103 as described above, in side-by-side relation to one another so the mine stopping panels extend between a floor and a ceiling of the mine passage and so the mine stopping panels collectively extend between ribs on opposite sides of the mine passage (e.g., as illustrated in FIG. 1). If desired, a jack (not shown) can be used to forcibly extend the panel members 105 of the panels 103 to create a pressure engagement between the ends of the panels and the abutting mine surfaces, as described and illustrated in U.S. Pat. Nos. 4,483,642 and 7,438,506, the contents of which are hereby incorporated by reference.

A foam material 135 is injected into the cavity 133 of one of the panels 103 through the injection inlet 141, 141', 141", or 141'" as illustrated by the arrows on FIGS. 18A-18C. Although FIGS. 18A-18C illustrate foam 135 being injected into the upper ends of the panels 103 the same method can be used to inject the foam material into the lower ends of the panels. The foam material 135 is suitably a low-pressure spray expanding foam (e.g., a polyurethane foam). For example, suitable foam materials 135, as well as suitable injection equipment, can be obtained from Fomo Products, Inc., of Norton, Ohio, such as the Fomo Products Silent-Seal® Mine Ventilation Air Sealant spray polyurethane foams. The foam material 135 fills the cavity 133 and flows through the openings 151 to help hold the panel 103 in side-by-side position relative to the adjacent panels. Foam 135 exiting the opening 151 of the panel 103 having the injection inlet 141' into which the foam is being injected can flow into the joint between adjacent panels. If the openings 151 of adjacent panels 103 are aligned, as they are in FIGS. 18A-18C, the foam material 135 can be flowed from the cavity 133 in the panel 103 through the openings and into the cavity or cavities of an adjacent panel or panels, as illustrated in FIG. 18B, e.g., by continuing to inject foam material into the cavity after there is sufficient foam material to fill the cavity. In many cases, some of the foam 135 will flow into the cavity 133 of the adjoining panel 103 while some of the foam will also flow into the joint between adjacent panels. Although it is possible to fill a single cavity 133 using its own injection inlet with a wide variety of different foams, including relatively quickly expanding foams, use of a slowly expanding foam can be desirable because it can facilitate flowing the foam material through the aligned openings 151 into the cavity 133 of an adjacent panel before the foam has expanded and started to increase in viscosity as it sets. The foam material 135 continues to expand after it flows into the cavity 133 of the adjacent panel 103 and at least partially fills the cavity of one or more adjacent panels. After the foam material 135 has fully expanded and cured (FIG. 18C), injectable foam material extends substantially continuously between the cavities 133 of the adjoining panels 103 through the aligned openings 151. The foam material 135 also contacts the floor and/or ceiling of the mine passage to help the stopping 101 block flow of air through the passage and to help hold the stopping in place in the passage. In some cases, it may be possible to completely fill the cavity 133 of the adjacent panel 103 by flowing the material 135 through the aligned openings 151 and thereby avoid the need to inject any foam material 135 into the cavity of the adjacent panel using the injection inlet on the adjacent panel. Thus, in one embodiment, the method includes substantially filling the cavity 133 of the adjacent panel 103 by flowing the foam material 135 through the openings 151. However, in many cases it is desirable to inject foam material into the cavity 133 of the adjacent panel 103 using the injection inlet 141 of the adjacent panel. Accordingly an embodiment of the method includes flowing the foam material 135 into the cavity 133 of the adjacent panel 103 through the openings 151 and also injecting foam material into the cavity of the adjacent panel using the injection inlet 141 on the adjacent panel.

Because the foam material 135 extends through the openings 151 and into the cavities 133 of adjacent panels 103 as a result of these methods, the foam material helps hold the adjacent panels in position relative to one another after the foam material has set up. This helps the panel members remain connected when under shear and or tension. Also, any foam material 135 in the joint helps glue the adjacent panels 103 to one another after it sets up. Thus, the foam 135 can contribute substantially to the stability of the 101 when it is applied according to the methods described herein.

Figure 19:
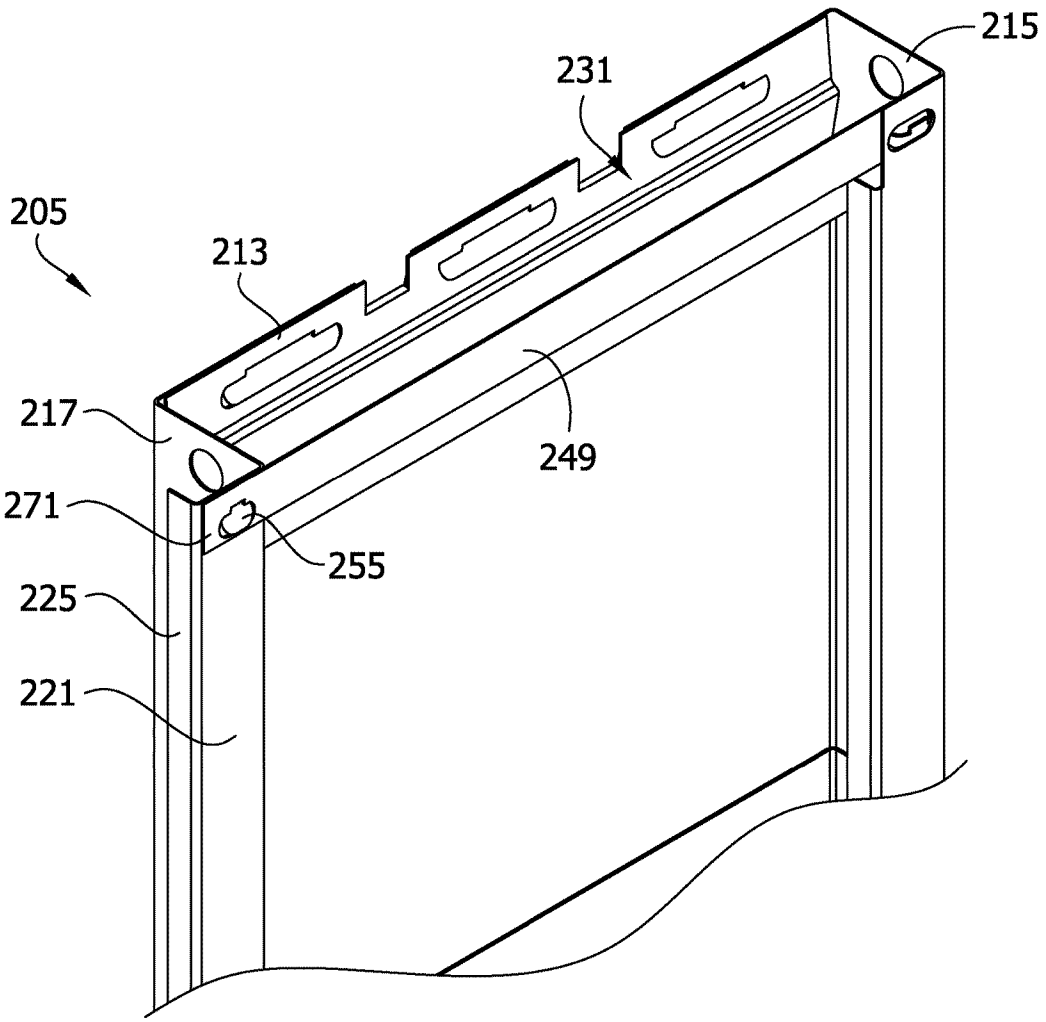
FIG. 19 is an enlarged perspective of a portion of another embodiment of a panel member for use in a mine stopping.

FIG. 19 illustrates another embodiment of a panel member 205 and end cap 231 that can be used to make a telescoping panel for use in a mine stopping. The panel member 205 and end cap 231 are substantially identical to the panel member 105 and end cap 131 described above except as noted. One of the differences in the panel member 205 is that one of the flanges 217 has an out-turned portion 221 extending generally parallel to the web 213 of the panel member 205 instead of an in-turned flange portion 121. The flange 217 has a lip portion 225 along an outer edge of the out-turned portion 221 extending back toward the web 213. The other flange 215 is substantially identical to the flange 115 of the panel member 105 described above. One of the differences in the end cap 231 is that the sidewall 249 on the opposite side of the cavity 233 from the web 213 of the panel member 205 has an cantilevered extension 271 configured to extend over the out-turned portion 221 of the flange 217. A louvered connection 255 connects the out-turned portion 221 of the flange 217 to the cantilevered extension 271 of the end cap.

The panel member 205 and end cap 231 operate substantially similarly to the panel member 105 and end cap 131 described above. Any of the injection inlets 141, 141', 141", or 141'" described above can be used with the panel member 205 and end cap 231 to allow the injectable foam material 135 to be injected into the end caps 231, as described above. However, when the panels formed by the panel member 205 are placed in side-by-side relation, the out-turned flange 217 of a panel member overlaps the in-turned flange 215 of an adjacent panel member, as described in more detail in U.S. Pat. No. 7,267,505, the entire contents of which are hereby incorporated by reference.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A mine stopping panel adapted to be installed between opposing first and second mine surfaces of a mine passage, the panel comprising;

a panel member of channel shape, the mine stopping panel member having a web, side flanges at opposite sides of the web, an upper end, and a lower end, an end cap attached to the panel member adjacent one of the upper and lower ends of the panel member in a position between the side flanges of the panel member adjacent an inside surface of the web of the panel member;

the end cap defining a cavity for receiving an injectable foam material;

an injection inlet for injecting said foam material into the first cavity; and at least one of:

(a) wherein said end cap comprises a base wall, a first side wall extending from the base wall adjacent the web of the panel member, and a second side wall spaced from the first side wall in a direction away from the web of the panel member, the injection inlet comprising an opening in the second side wall of the end cap;

(b) wherein said end cap comprises a base wall, a first side wall extending from the base wall adjacent the web of the panel member, and a second side wall spaced from the first side wall in a direction away from the web of the panel member, the injection inlet comprising an opening in the base wall of the end cap; or (c) wherein said end cap comprises a base wall, a first side wall extending from the base wall adjacent the web of the first panel, and a second side wall spaced from the first side wall in a direction away from the web of the panel member, the injection inlet comprising a pair of aligned openings in the web of the panel member and the first side wall of the end cap.

2. The mine stopping panel of claim 1, wherein the end cap is positioned at the upper end of the panel member.

3. The mine stopping panel of claim 1, wherein the end cap is positioned at the lower end of the panel member.

4. The mine stopping panel of claim 1, wherein the panel member is a first panel member, the end cap is a first endcap, the cavity is a first cavity, and the injection inlet is a first injection inlet, the mine stopping panel further comprising:

a second panel member of channel shape arranged for telescoping movement relative to the first panel member, the second panel member having a web, flanges at opposite sides of the web, an upper end, and a lower end; and a second end cap, the second end cap being attached to the second panel member adjacent one of the upper and lower ends of the second panel member in a position extending between the first and second flanges of the second panel member adjacent an inside surface of the web of the second panel member;

the second end cap defining a second cavity for receiving an injectable foam material; and a second injection inlet for injecting said foam material into the second cavity.

5. The mine stopping panel of claim 1, wherein each of the side flanges comprises an in-turned portion at its outer edge extending generally parallel to the web of the panel member.

6. The mine stopping panel of claim 1, wherein a first of said side flanges comprises an in-turned portion at its outer edge extending generally parallel to the web of the panel member and a second of the side flanges comprises an out-turned portion at its outer edge extending generally parallel to the web of the panel member.

7. The mine stopping panel of claim 6, wherein the end cap comprises a base wall, a first side wall extending from the base wall adjacent the web of the panel member, and a second side wall spaced from the first side wall in a direction away from the web of the panel member, the second side wall comprising a cantilevered extension extending over the out-turned portion of said second side flange.

8. The mine stopping panel of claim 7, further comprising louvered connections securing the end cap to the panel member, the louvered connections including a first louvered connection connecting said out-turned portion of the second flange to said cantilevered extension of the second side wall of the end cap and a second louvered connection connecting the second sidewall of the endcap to the in-turned portion of the first flange.

9. The mine stopping panel of claim 1 wherein the injection inlet is configured so it opens laterally outward and/or longitudinally inward from the adjacent end of the panel.

10. A mine stopping panel adapted to be installed between opposing first and second mine surfaces of a mine passage, the panel comprising;

a panel member of channel shape, the mine stopping panel member having a web, side flanges at opposite sides of the web, an upper end, and a lower end, an end cap attached to the panel member adjacent one of the upper and lower ends of the panel member in a position between the side flanges of the panel member adjacent an inside surface of the web of the panel member;

the end cap defining a cavity for receiving an injectable foam material;

an injection inlet for injecting said foam material into the first cavity, and an opening in at least one of the first and second side flanges of the panel member for allowing foam material injected into the cavity to flow out of the cavity in a lateral direction.

11. A mine stopping comprising first and second mine stopping panels as recited in claim 10, wherein the opening of the first mine stopping panel is aligned with the opening of the second mine stopping panel for allowing foam material injected in the cavity of the first mine stopping panel to flow in to the cavity of the second mine stopping panel through the aligned openings.

12. A mine stopping panel adapted to be installed between opposing first and second mine surfaces of a mine passage, the panel comprising;

a panel member of channel shape, the mine stopping panel member having a web, side flanges at opposite sides of the web, an upper end, and a lower end, an end cap attached to the panel member adjacent one of the upper and lower ends of the panel member in a position between the side flanges of the panel member adjacent an inside surface of the web of the panel member;

the end cap defining a cavity for receiving an injectable foam material;

an injection inlet for injecting said foam material into the first cavity; and wherein the injection inlet is spaced at least about 2 inches from the side flanges.

13. A mine stopping comprising a plurality of mine stopping panels as set forth in claim 1 arranged in generally side-by-side relation to one another and a foam material in the cavities of the mine stopping panels.

14. The mine stopping of claim 13 wherein the foam material extends substantially continuously between the cavity of a first of said mine stopping panels and a cavity of a second of said mine stopping panels.

15. The mine stopping of claim 14 wherein the foam material extends into a joint between the first and second mine stopping panels.

16. A method of sealing a mine passage, the method comprising:

arranging a plurality of mine stopping panels in side-by-side relation to one another so the mine stopping panels extend between a floor and a ceiling of the mine to form a mine stopping, wherein at least one of the mine stopping panels comprises:

a panel member of channel shape, the mine stopping panel member having a web, side flanges at opposite sides of the web, an upper end, and a lower end;

an end cap attached to the panel member adjacent one of the upper and lower ends of the panel member in a position between the side flanges of the panel member adjacent an inside surface of the web of the panel member;

the end cap defining a cavity for receiving an injectable foam material and an injection inlet for injecting said foam material into the cavity; and injecting a foam material into the cavity through the injection inlet;

wherein said at least one mine stopping panel is a first mine stopping panel, the panel member is a first panel member, the end cap is a first end cap, and the cavity is a first cavity, and wherein said plurality of mine stopping panels further comprises a second mine stopping panel adjacent the first mine stopping panel, and wherein the first mine stopping panel has an opening in one of the side flanges of the first mine stopping panel, the method further comprising:

flowing the injectable foam material from the first cavity in the first panel member through the opening in the flange of the first panel member so the injectable foam material extends from the first cavity to the second panel member through the opening in the flange of the first panel member.

17. The method of claim 16 wherein the second mine stopping panel comprises:

a panel member having a channel shape, the second mine stopping panel member having:

a web;

side flanges at opposite sides of the web;

an opening in at least one of the side flanges;

an upper end; and a lower end, a second end cap attached to the second panel member adjacent one of the upper and lower ends of the panel member in a position between the side flanges of the second panel member adjacent an inside surface of the web of the second panel member, the second end cap defining a second cavity for receiving the injectable foam material, the method further comprising flowing the injectable foam material from the first cavity in the first panel member through the openings in the flanges of the first and second panel members into the second cavity so the injectable foam material extends substantially continuously between the first and second cavities.

18. The method of claim 17 further comprising injecting additional injectable foam material into the second cavity through an injection inlet on the second mine stopping panel.

19. The method of claim 16 further comprising allowing the foam to cure and form a seal.

20. A mine stopping panel adapted to be installed between opposing first and second mine surfaces of a mine passage, the panel comprising;

a panel member of channel shape, the mine stopping panel member having a web, side flanges at opposite sides of the web, a first end, and a second end, an end cap attached to the panel member adjacent the first end of the panel member in a position between the side flanges of the panel member adjacent an inside surface of the web of the panel member;

the end cap at least partially defining a cavity for receiving an injectable foam material;

a mine engagement surface defined by at least one of the end cap and the first end of the panel member, the mine engagement surface arranged to engage one of the first and second opposing mine surfaces when the mine stopping panel is installed in the mine passage, and an injection inlet for injecting said foam material into the first cavity, the injection inlet comprising an injection opening located toward the second end of the panel member from the mine engagement surface.

21. The mine stopping panel of claim 20, wherein said end cap comprises a base wall, a first side wall extending from the base wall adjacent the web of the panel member, and a second side wall spaced from the first side wall in a direction away from the web of the panel member, the injection opening located in the second side wall of the end cap.

22. The mine stopping panel of claim 20, wherein said end cap comprises a base wall, a first side wall extending from the base wall adjacent the web of the panel member, and a second side wall spaced from the first side wall in a direction away from the web of the panel member, the injection opening located in the base wall of the end cap.

23. The mine stopping panel of claim 20, wherein said end cap comprises a base wall, a first side wall extending from the base wall adjacent the web of the first panel, and a second side wall spaced from the first side wall in a direction away from the web of the panel member, wherein the injection opening is a first injection opening in the web of the panel member and the injection inlet comprises a second injection opening in the first side wall of the end cap.

24. The mine stopping panel of claim 20, wherein the mine engagement surface comprises a rim extending at least partially around an open end of the cavity at the first end of the panel member.

25. The mine stopping panel of claim 20, wherein the injection opening passes through the web of the panel member.

26. The mine stopping panel of claim 25, wherein web defines an edge of the injection opening extending fully around the injection opening.

27. The mine stopping panel of claim 20, wherein the injection opening is spaced at least about 2 inches from the side flanges.

28. A method of sealing a mine passage, the method comprising:

arranging a plurality of mine stopping panels in side-by-side relation to one another so the mine stopping panels extend between first and second opposing surfaces of the mine to form a mine stopping, wherein at least one of the mine stopping panels comprises:

a panel member of channel shape, the mine stopping panel member having a web, side flanges at opposite sides of the web, a first end, and a second end;

an end cap attached to the panel member adjacent the first end of the panel member in a position between the side flanges of the panel member adjacent an inside surface of the web of the panel member;

the end cap at least partially defining a cavity for receiving an injectable foam material;

a mine engagement surface defined by at least one of the end cap and the first end of the panel member, the mine engagement surface in engagement with the first mine surface; and an injection inlet for injecting said foam material into the cavity, the injection inlet comprising an injection opening located toward the second end of the panel member from the mine engagement surface; and injecting a foam material into the cavity through the injection opening.

* * * * *